US006587843B1

(12) United States Patent
Gelfer et al.

(10) Patent No.: US 6,587,843 B1
(45) Date of Patent: Jul. 1, 2003

(54) METHOD FOR IMPROVING THE SECURITY OF POSTAGE METER MACHINES IN THE TRANSFER OF CREDIT

(75) Inventors: George G. Gelfer, Glen Ellyn, IL (US); Enno Bischoff, Berlin (DE); Wolfgang Thiel, Berlin (DE); Andreas Wagner, Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 08/955,072

(22) Filed: Oct. 21, 1997

Related U.S. Application Data

(63) Continuation of application No. 08/572,933, filed on Dec. 15, 1995, now abandoned.

(51) Int. Cl.[7] ..... G07B 17/00
(52) U.S. Cl. ..... 705/60; 705/403
(58) Field of Search ..... 705/50, 60, 61, 705/401, 403

(56) References Cited

U.S. PATENT DOCUMENTS

| | | | | |
|---|---|---|---|---|
| 4,760,534 A | * | 7/1988 | Fougere et al. | 235/375 |
| 5,671,146 A | * | 9/1997 | Windel et al. | 364/464.2 |
| 5,805,711 A | * | 9/1998 | Windel et al. | 380/55 |
| 5,844,220 A | * | 12/1998 | Eddy et al. | 235/381 |
| 6,058,384 A | * | 5/2000 | Pierce et al. | 705/50 |

FOREIGN PATENT DOCUMENTS

| | | |
|---|---|---|
| EP | 0 576 113 | 12/1993 |
| EP | 0 578 042 | 1/1994 |
| EP | 0972956 A2 * | 7/1999 |

OTHER PUBLICATIONS

"Pitney Bowes Licenses the Certicom Elliptic Curve Engine to Secure Postal Metering Applications: Unique Secure Electronic Commerce Application Meets Special Need of Small Office/Home Office"; Business Wire, Sep. 23, 1997, p 9230113.*

* cited by examiner

*Primary Examiner*—Edward R. Cosimano
(74) *Attorney, Agent, or Firm*—Schiff Hardin & Waite

(57) ABSTRACT

In a method for improving the security of postage meter machines in credit transfers, having at least two modes, the presence of a security flag is necessary for operation of the machine. The security flag is erased in a step of the system routine if an unauthorized action occurs in an attempt to operate the postage meter machine, and the postage meter machine is switched into a first mode in order to effectively shut it down. Otherwise, a special mode for negative remote crediting is entered by setting a special flag when a predetermined operating action for lateral entry into the special mode is undertaken upon machine turn-on. The communication with the data center sequences under time and status (flag) monitoring by the control unit of the postage meter machine until the transaction is completed. The data center monitors the behavior of the postage meter machine user on the basis of data communicated during the transaction.

40 Claims, 8 Drawing Sheets

DZ SEQUENCE IN THE DATA CENTER

FM
M
L
K
I
H
DZ
ERROR HANDLING CANCEL LAST TRANSACTION
510
END OF PREFIX?
507
Y
N
START MESSAGE RECEIVED, DATA OK?
508
Y
N
SEND START MESSAGE ENCRYPTED
313
COMM. ERROR?
314
Y
N
ERROR CORRECTABLE?
509
Y
N
RECEIVE TRANSACTION DATA, INCLUDING CURRENT DATA
315
CARRY OUT TRANSACTION
511
DATE ERROR-FREE?
316
Y
N
STORE DATA, INCLUDING CURRENT DATA
318
B
STORE DATA
512
A

S
E
D
C
401
INPUT ROUTINE
402
DISPLAY ROUTINE
403
PRINT DATA EDITING
INCREMENT RUN COUNTER
407
N
Y
404
INPUT REQUEST?
408
405a
Y
N
405
STAND BY-FLAG
RUN COUNT > G?
Y
PRINT OUTPUT REQUEST?
N
213
409
Y
VALID SECURITY FLAG X PRESENT AND REGISTER CHECKS OK?
N
STATISTICS AND ERROR EVALUATION
E
Y
N
S > 0 ?
SET FLAG Z
410
411
ACCOUNTING AND PRINTING ROUTINE
406
215
DISPLAY MODE

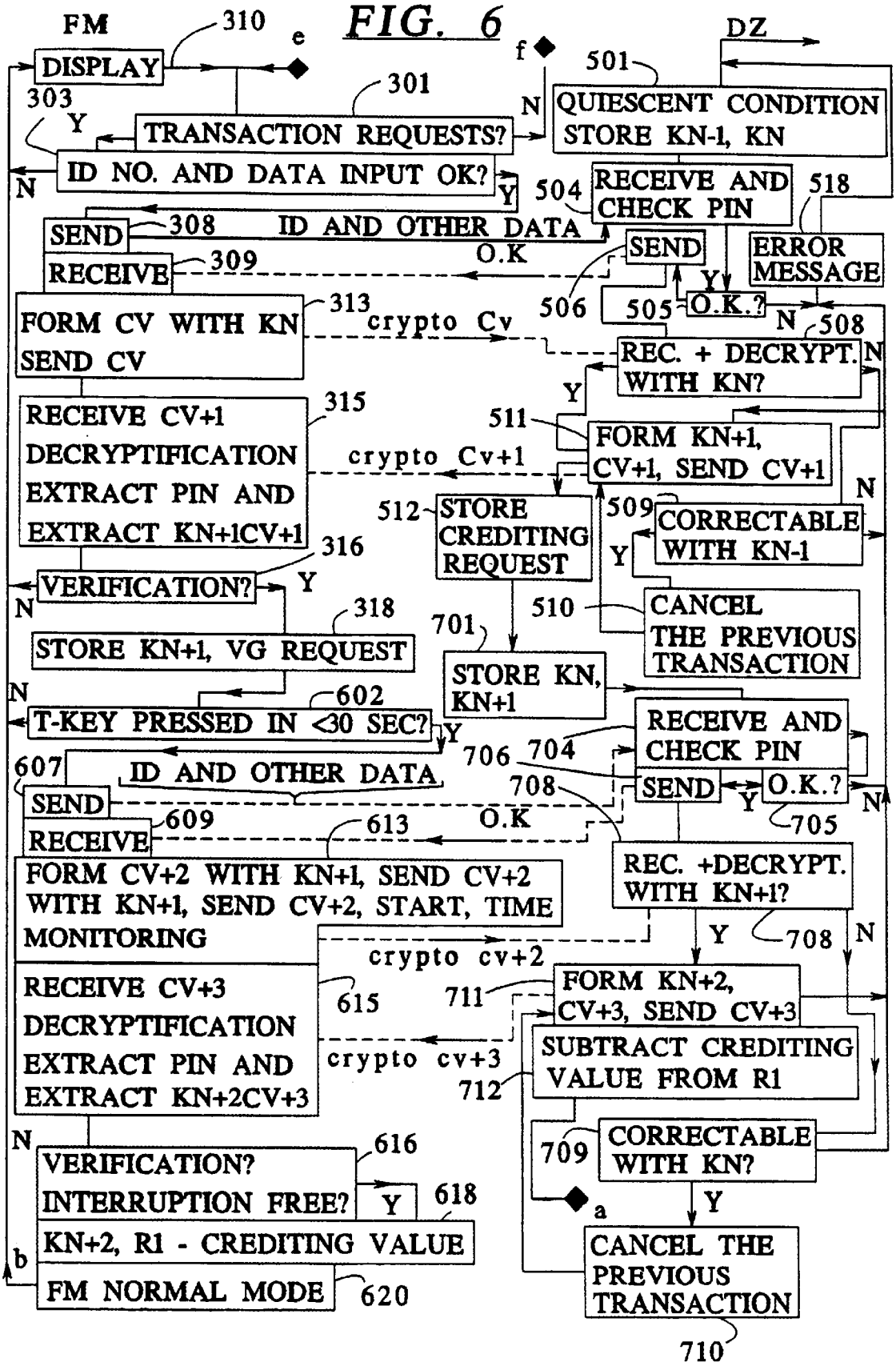
FIG. 6
FM
DZ
DISPLAY
310
e
f
501
QUIESCENT CONDITION STORE KN-1, KN
301
303
Y
N
TRANSACTION REQUESTS?
ID NO. AND DATA INPUT OK?
N
Y
504
RECEIVE AND CHECK PIN
518
SEND
308
ID AND OTHER DATA
RECEIVE
309
O.K
SEND
ERROR MESSAGE
506
505
O.K.?
Y
N
508
313
FORM CV WITH KN SEND CV
crypto Cv
REC. + DECRYPT. WITH KN?
N
Y
315
511
RECEIVE CV+1 DECRYPTIFICATION EXTRACT PIN AND EXTRACT KN+1CV+1
crypto Cv+1
FORM KN+1, CV+1, SEND CV+1
N
512
STORE CREDITING REQUEST
509
CORRECTABLE WITH KN-1
Y
316
VERIFICATION?
Y
N
510
CANCEL THE PREVIOUS TRANSACTION
318
701
STORE KN+1, VG REQUEST
STORE KN, KN+1
N
602
T-KEY PRESSED IN <30 SEC?
Y
RECEIVE AND CHECK PIN
706
704
607
ID AND OTHER DATA
708
SEND
O.K.?
Y
N
705
SEND
609
613
O.K
RECEIVE
REC. +DECRYPT. WITH KN+1?
FORM CV+2 WITH KN+1, SEND CV+2 WITH KN+1, SEND CV+2, START, TIME MONITORING
Y
708
N
crypto cv+2
711
FORM KN+2, CV+3, SEND CV+3
RECEIVE CV+3 DECRYPTIFICATION EXTRACT PIN AND EXTRACT KN+2CV+3
615
crypto cv+3
SUBTRACT CREDITING VALUE FROM R1
712
N
616
VERIFICATION? INTERRUPTION FREE?
Y
618
709
CORRECTABLE WITH KN?
a
Y
KN+2, R1 - CREDITING VALUE
b
FM NORMAL MODE
620
CANCEL THE PREVIOUS TRANSACTION
710

METHOD FOR IMPROVING THE SECURITY OF POSTAGE METER MACHINES IN THE TRANSFER OF CREDIT

This is a continuation, of application Ser. No. 08/572,933, filed Dec. 15, 1995 abandoned.

BACKGROUND OF THE INVENTION

The invention is directed to a method for improving the security of postage meter machines in the transfer of credit, specifically in the retransfer of funds to the data central.

DESCRIPTION OF THE PRIOR ART

A postage meter machine usually generates an imprint in a form agreed upon with the postal system: flush right, parallel to the upper edge of the postal matter beginning with the content of the postage in the postage stamp, date in the postmark and stamp imprints for advertising slogan and, possibly, type of mailing in the selective imprint. The postage value, the date and the type of mailing thereby form the variable information being input in conformity with the item to be mailed.

The postage value is usually the delivery fee (postage) prepaid by the sender that is subtracted from a refillable credit register and is employed for franking the postal mailing. In the current account method, by contrast, a register is merely incremented dependent on the frankings undertaken with the postage value and is read by a postal inspector at regular intervals.

In general, every franking that has been undertaken must be accounted for and every manipulation that leads to a non-debited franking must be prevented.

A known postage meter machine is equipped with at least one input unit, one output unit, an input/output control module, a memory containing the operating program, data and, in particular, the accounting registers, a control unit and a printer module. Given a printer module with print mechanism, measures must also be undertaken so that the print mechanism cannot be misused for undebited imprints in the deactivated condition.

In a postage meter machine disclosed in U.S. Pat. No. 4,746,234, fixed and variable data are stored in memories (ROM, RAM) in order to read out this data with a microprocessor when a letter on the conveying path actuates a micro-switch preceding the printing position in order to form a print control signal. The fixed and variable data are subsequently electronically combined to form a print format and can be printed on the envelope to be franked by thermo-transfer printing means.

A method for controlling the column-by-column printing of a postal value stamp in a postage meter machine is disclosed in European Application 578 042, wherein fixed and variable data are converted into graphic pixel image data separately from one another during the column-by-column printing. It therefore becomes difficult to undertake a manipulation at the print control signal without significant and expensive efforts when the printing ensues at high speed.

The memory arrangement in known postage meter machines also has at least one non-volatile memory module that contains the currently remaining credit, this resulting from the substraction of the postage value to be printed from a credit loaded into the postage meter machine earlier. The postage meter machine becomes inhibited when the remaining credit is zero.

Known postage meter machines contain three relevant postal registers in at least one memory for total used value (ascending register), residual credit still available (descending register) and a check sum register. The check sum is compared to the sum of total value used and available credit. This already makes a check for proper accounting possible.

It is also possible to transmit reloading information to the postage meter machine from a data central by means of a remote crediting procedure in order to reload a credit into the register for the remaining credit (residual value). Suitable security measures must be undertaken for this purpose so that the credit stored in the postage meter machine cannot be replenished in an unauthorized fashion. The aforementioned solutions to protect against misuse and counterfeiting attempts require additional outlay in terms of material and time.

U.S. Pat. No. 4,864,506 discloses entering into a communication to the remote data central, initiated by the postage meter machine, when the value of the credit in the descending register lies below a threshold for a predetermined length of time.

The aforementioned patent also discloses establishing communication with the postage meter machine, initiated by the data central, after a defined time span, and the postage meter machine only replies at predetermined times for receiving register data and for checking whether the postage meter machine is still connected to a specific telephone number.

The aforementioned patent also teaches interrogating the identification number of the postage meter machine and the values in the descending and ascending registers for authorization by the data central before a reloading of credit into the postage meter machine.

The aforementioned patent also discloses that the communication of the data central with the postage meter machine need not remain limited to merely a transfer of credit into the postage meter machine. In the case of a log-off of the postage meter machine, the communication of the data central with the postage meter machine is utilized in the data central for transferring the remaining credit of the postage meter machine. The value in the descending postal register of the postage meter machine is then zero, effectively deactivating the postage meter machine.

A security housing for postage meter machines that has internal sensors is disclosed by German OS 41 29 302. In particular, the sensors are equipped with switches connected to a battery, these switches being activated when the security housing is opened and automatically causing erasure of a memory (descending postal register) that stores the residual credit, by interrupting the energy supplied. As is known, however, it cannot be predicted what condition a voltage-high memory module will assume when the voltage is restored. Thus, an unpaid, higher residual credit could arise in the memory upon power restoration. Moreover, it cannot be precluded that the remaining value of the credit is at least partially discharged in the aforementioned way. This, however, would be disadvantageous in the case of an inspection since the remaining credit that has been paid by the postage meter machine user must be loaded again, but the amount of this remaining credit can be falsified by the aforementioned measures. This reference does not disclose how one can prevent a manipulator from restoring an unpaid residual credit.

Further security measures such as break-away screws and an encapsulated, shielded security housing are already used in known postage meter machines. Keys and a combination lock are also standard in order to make access to the postage meter machine more difficult.

U.S. Pat. No. 4,812,994 teaches prevention of an unauthorized access to a use of the postage meter machine by, in addition to standard measures, inhibiting the postage meter machine given the incorrect entry of a predetermined. password. Moreover, the postage meter machine can be set, by means of a password and an appropriate input via a keyboard, such that a franking is only possible during a predetermined time interval, or at predetermined times of day.

The password can be entered into the postage meter machine by a personal computer via modern, by a chip card or manually. The postage meter machine is enabled after a positive comparison to a password stored in the postage meter machine. A security module (EPROM) is integrated in the control module of the accounting unit or debiting unit. As a further security measure, an encryption module (separate microprocessor or program for the franking machine CPU based on DES or RSA code) is provided, which generates a recognition number in the franking stamp that includes the postage value, the user number, a transaction number and the like. It is still possible, however, that a password could be discovered and could be put into the possession of a manipulator together with the postage meter machine.

U.S. Pat. No. 4,812,965 discloses a remote inspection system for postage meter machines that is based on specific messages in the imprint of postal mailings that must be sent to the data central, or is based on a remote interrogation via modem. Sensors inside the postage meter machine are intended to detect every counterfeiting action that is undertaken so that a flag can be set in appropriate memories in case an intervention was made in the postage meter machine for manipulative purposes. Such an intervention could ensue in order to load an unpaid credit into the registers.

When a manipulation is detected, the postage meter machine is inhibited during the remote inspection via modem by a signal transmitted from the data central. A skillful manipulation nonetheless could be made by resetting the flag and the registers into the original condition after producing franking imprints that have not been accounted for. Such a manipulation could not be recognized by the data central via remote inspection if this canceled manipulation were before the remote inspection. Receiving the postcard from the data central on which a franking for inspection purposes is to be made allows the manipulator to return the postage meter machine into the original condition in adequate time. Thus, higher security cannot be achieved in this way.

A disadvantage of such a system is that one cannot prevent a knowledgeable manipulator who breaks into the postage meter machine from subsequently eliminating evidence of the tampering by erasing the flags. Further, this system cannot prevent that an imprint produced by a properly operated machine from being manipulated. This is because in known machines, there is the possibility of producing imprints with the postage value of zero. Such zero frankings are required for testing purposes and could also be subsequently falsified by simulating a postage value greater than zero.

A security imprint is disclosed in European Application 576 113 assigned to Francotyp-Postalia which provides symbols in a marking field in the franking stamp that contain encrypted informations. This allows the postal authority that collaborates With the data central to recognize a manipulation at the postage meter machine at arbitrary points in time based on the visual analysis of the security imprint Although an ongoing monitoring of such postal mailings provided with a security imprint is technically possible by means of corresponding security marks in the stamp format, this requires an additional outlay in the post office. A manipulation, however, is usually only found later given a monitoring based on random samples.

Knowledge that a postage meter machine was operated by the user beyond the inspection date can be obtained in the data center, however, this knowledge is not sufficient to allow a conclusion to be made regarding whether a manipulation was undertaken for counterfeiting purposes.

U.S. Pat. No. 4,251,874 has a mechanical printer that must be preset for printing and that must be employed with a detector in order to monitor the presetting. Further, means for identifying errors in the data and control signals are provided in the electronic accounting system. When this error number reaches a predetermined value, further operation of the postage machine is interrupted. The sudden outage of the postage meter machine, however, is disadvantageous for the user of the postage meter machine. Given a non-mechanical printing principle, by contrast, such internal errors are not normally anticipated and the postage meter machine is to be shut off immediately anyway given a serious fault. Moreover, the security against manipulation of the postage meter machine does not become significantly greater as a result of the fact that the postage meter machine is turned off after a predetermined number of errors.

U.S. Pat. No. 4,785,417 discloses a postage meter machine with program sequence monitoring. The correct execution of a relatively large program segment is monitored with a specific code allocated to each program part, this code being stored in a specific memory cell in the RAM when the program segment is called. A check is then made to determine whether the code stored in the aforementioned memory cell is still present in the program part which is sequencing at the moment. If the run of a program part were interrupted by a manipulation and a different program part were to sequence, an error can be determined by such a monitoring interrogation The comparison, however, can only be implemented in the main sequence. Sub-sequences, for example security-associated calculations that are used by a number of main sequences, cannot be monitored by such a monitoring for execution of the program part because the program check ensues independently of the program sequence. If, on the basis of allowed program parts and sub-sequences, manipulation was carried out such that sub-sequences were additionally incorporated into the main sequences or were omitted therefrom, or if a branch is made to sub-sequences, then no error would be found since no determination about the length of the program part can be made nor can a determination be made as to what program branch was run nor how often a program branch was run.

Another type of anticipated manipulation is the reloading of the postage meter machine registers with a credit value that has not been accounted for. There is thus a requirement for protected reloading. An additional security measure according to U.S. Pat. No. 4,549,281 is the comparison of an internal, invariable combination, stored in a non-volatile memory, to an entered, external combination, whereby the postage meter machine is inhibited by means of inhibition electronics after a number of failed attempts, i.e. non-identity of the combinations. According to U.S Pat. No. 4,835,697, the combination can be fundamentally changed in order to prevent an unauthorized access to the postage meter machine.

U.S. Pat. No. 5,077,660 also discloses a method for changing the configuration of the postage meter machine, whereby the postage meter machine is switched from the operating mode into a configuration mode with a suitable entry via a keyboard and a new meter type number can be entered, this corresponding to the desired number of features. The postage meter machine generates a code for the combination using the computer of the data central and the entry of the identification data and the new meter type number in the data center computer, that likewise generates a corresponding code for communication to and entry into the postage meter machine, in which the two codes are compared. Given coincidence of the two codes, the postage meter machine is configured and switched into the operating mode. The data center thus always has exact records regarding the current setting for the corresponding postage meter machine. The security reliability is dependent, however, only on the level of sophistication of the encoding technique used to encode the transmitted code.

European Application 388 840 discloses a comparable security technology for setting a postage meter machine in order to clear this machine of data without the postage meter machine having to be transported to the manufacturing company. Again, the security reliability is dependent only on the sophistication of the encoding of the transmitted code.

Secured reloading of a postage meter machine with a credit is achieved in a system described in U.S. Pat. No. 3,255,439 wherein an automatic signal transmission from the postage meter machine to the data central is initiated whenever a predetermined amount of money that was franked or a piece number of processed postal mailings or a predetermined time period was reached. Alternatively, a signal corresponding to the sum of money, the piece number or time period can be communicated. The communication thereby ensues with binary signals via converters connected to one another via a telephone line. The machine receives a likewise secured reloading corresponding to the credit balance and is inhibited when no credit is resupplied.

U.S. Pat. No. 4,811,234 discloses implementing transactions in encoded form and interrogating the registers of the postage meter machine, with the registered data being communicated to the data center in order to indicate a chronological reference for the reduction of the authorized amount stored in the register. The postage meter machine identifies itself at the data central when a preset threshold is reached, by means of its encoded register content. The data center modifies the requested franking amount up to which franking is allowed to be carried out with corresponding authorization signals. The encoding is thus the only protection against a manipulation of the register readings. Therefore, if a manipulator properly loads the same amount at the same time intervals but franks an amount with the manipulated postage meter machine in the meantime that is far higher than the amount he paid, the data center cannot find any manipulation.

European Application 516 403 discloses logging errors of the postage meter machine and storing them in a memory for regular transmittal to a remote error analysis computer for interpretation. Such a remote inspection allows an early warning before an error occurs and enables recourse to further measures (service). This, however, does not yet offer an adequate criterion for a manipulation According to British Specification 22 33 937 and U.S. Pat. No. 5,181,245, the postage meter machine periodically communicates with the data center. An inhibit means allows the postage meter machine to be inhibited and delivers an alarm to the user after the expiration of a predetermined time, or after a predetermined number of operation cycles. For enabling an encrypted code must be entered from the outside, this being compared to an internally generated, encrypted code. In order to prevent incorrect accounting data from being supplied to the data center, the accounting data are involved in the encryption of the aforementioned code. A disadvantage of this known approach is that the warning ensues simultaneously with the inhibit of the postage meter machine without the user having any possibility to take corrective steps in time (i.e., before the machine is inhibited).

U.S. Pat. No. 5,243,654 discloses a postage meter machine wherein the continuous time data supplied by the clock/date module are compared to stored deactivation time data. When the time represented by the stored data is reached by the current time, the postage meter machine is deactivated, i.e. printing is prevented. Given communication with a data center that reads the accounting data from the ascending register, the postage meter machine has an encrypted combination value communicated to it and a new term is set, as a result of which the postage meter machine is again made operational. The total used amount that contains the sum of used postage and read by the data center, is likewise a component of the combination value communicated in encrypted form. After the encryption of the combination value, the total used amount is separated and compared to the total used amount stored in the postage meter machine. When the comparison is positive, the inhibit of the postage meter machine is automatically canceled. This solution thus requires the postage meter machine to report periodically to the data center in order to communicate accounting data. Instances are conceivable, however, wherein the volume of mail to be franked fluctuates (seasonal operation). In these instances, the postage meter machine would be disadvantageously inhibited unnecessarily often.

U.S. Pat. No. 4,760,532 discloses a mail handling system with the capability of transfer of postal values and accounting information. Data is thereby communicated to the data center via telephone with the touch-tone method widespread in the U.S.A. By pressing an appropriate key of the telephone, the user can transmit a number. Information from the data center is communicated to the operator with a computer voice, the operator having to enter the transmitted values into the postage meter machine. For retransferring funds, the transfer of a negative postal value to a postal device is provided in a first step for setting up a communication to the central station. The central station monitors the total amount of mail (remaining credit) that is stored in the postal device. In second step, the central station is supplied with data related to a desired exchange in order to reduce the total amount of postal values that is available in the aforementioned postal device, and is also supplied with an unambiguous identification relating to the aforementioned postal device. In a third step, a first unambiguous code is received from the central station and entered into the aforementioned postal device. The entry is conducted in order to reduce the total Sum of postal values that are stored in the postal device in agreement with the aforementioned request. In a fourth step, a second unambiguous code is generated in the postal device from the first unambiguous code that was entered into the postal device. The second unambiguous code supplies an indication that the aforementioned postal value, that is available for imprinting the mail, has been reduced in the postal device. If, however, the transmission is disturbed or interrupted, then the data center does not receive a first code and the amount of money in the postal meter machine would remain unmodified, whereas a reaccounting would already have been undertaken in the data center. For checking, of course, the registered readings of the postal meter machine could be interrogated in order to compare these to those stored in the data center. It must be expected, however, that a manipulator would omit the latter. As a final step, U.S. Pat. No. 4,760,532 provides for the transmission of the aforementioned, second unambiguous code to the central station. Under the conditions of the touch-tone method, a re-actuation of numerical keys is required, this being complicated given a multi-place code and usually not sequencing free of input errors. It is also possible for the data center to generate a third, unambiguous code in order to transfer the returned credit to another postage meter machine. The responsible authority can thus be harmed by errors during the transmission. The same problem arises given negative as well as positive remote crediting, namely that of achieving a synchronism of the data in the center and the postage meter machine in a simple way.

SUMMARY OF THE INVENTION

The invention is particularly directed to postage meter machines that supply a fully electronically generated imprint for franking postal matter, including the printing of an advertising slogan, which avoids the aforementioned problems of known devices. Since there is no printing mechanism which can be manipulated, it is only a valid franking that has not been accounted for which must be prevented.

It is a further object to improve the security in a communication with the data center when data are communicated in both directions.

The inventive solution is based on the premise that only data centrally stored in a data center can be adequately protected against manipulation. A significant increase in security and synchronism in the stored data is achieved by generating a data report before every predetermined action at the postage meter machine. The reporting ensues at relatively long time intervals, particularly for reloading a credit, enhancing security against a potential manipulation in conjunction with the aforementioned logging. The data to be centrally stored include at least date, time of day, identification number of the postage meter machine (ID number or PIN) and the type of data (for example, register values parameters) when the postage meter machine enters into communication with the data center. For the purpose of pre-synchronization of the data of the postage meter machine with the data of the data center, a specific prescribed request can be employed as a first transaction.

In order to further enhance the security, a distinction is made between authorized action (service technician) and unauthorized action (manipulative intent) With the control unit of the postage meter machine in conjunction with the steps for the implementation of a "negative" remote crediting for returning a credit value into the data center, whereby a setting from the postage meter machine is communicated to the data center and is stored there and in the postage meter machine.

The control unit of the postage meter machine thereby checks whether a defined procedure for lateral entry into the special mode for negative remote crediting was undertaken with predetermined actuation elements, whether a predetermined time sequence was followed during the negative remote crediting, and whether further steps must be implemented for the automatic implementation of the communication in order to complete there turn transfer if the preceding steps for the implementation of a negative remote crediting were interrupted or if incorrectly encrypted data were communicated to the postage meter machine.

Inventively, a communication ensues between the postage meter machine and the data center at least with encrypted messages, the DES algorithm preferably being employed.

For achieving the object, the postage meter machine thus is operable in at least two special modes. A first mode (kill mode) is provided in order to prevent the postage meter machine from franking with postage values given fraudulent actions or given manipulative intent. This inhibit can be canceled on the occasion of the next on site inspection by a person authorized to do so. The postage meter machine is also operable in a further mode in order to initiate, as warranted, entry of the postage meter machine into automatic communication with the data center when selected criteria are met. In such a further mode, the second special mode for negative credit transfer or a sleeping mode can be entered. After the completion of the special mode, only a limited number of zero frankings are possible for testing the postage meter machine. When this number of frankings has occurred, an automatic communication with the data center is necessarily triggered, the data center thus being informed that the limit for permissible zero frankings has been reached and also being informed of relevant register data of the postage meter machine. The postage meter machine is inhibited in the sleeping mode for this time. The interaction of at least these two aforementioned modes enhances the security against fraudulent manipulation in the handling of credits that are loaded into the postage meter machine or are to be transferred back therefrom to the data center.

In a first version of the invention, the security is achieved by a predetermined operating sequence during the turn-on of the postage meter machine for lateral entry into the special mode for negative remote crediting, as well as later when the postage meter machine has entered into the communication connection, by messages during two transactions communicated encrypted. As the result of a first transaction, a predetermined crediting request is stored in the data center and in the postage meter machine. It is thus no longer necessary to again communicate the stored crediting request during a second transaction. As a result of the second transaction, a corresponding crediting value is subtracted from the content of the descending register, or a negative value is added thereto, so that a zero credit is stored in the postage meter machine.

If, however, an operating sequence other than the predetermined operating sequence occurs during the turn-on of the postage meter machine for lateral entry into the special mode negative remote crediting, this other operating sequence being prohibited, the postage meter machine switches into the aforementioned first mode in order to inhibit the postage meter machine from franking with a postage value (kill mode).

For the purpose of enhancing the security against manipulation the data center may have previously modified a lateral entry of the special mode for negative remote crediting, which was already communicated earlier to the authorized operator (service technician). The operating sequence which will be valid in the future can be partially or completely communicated in conjunction with at least one transaction during a positive or negative remote crediting.

An authorized operator of the postage meter machine, preferably the service technician, implements a predetermined operating action for lateral entry into the special mode negative remote crediting, this being known only to the data center in addition to being known to the service technician. A special flag is thus set that is interpreted as specific transaction attempts.

Monitoring by the control unit of the postage meter machine during the implementation of a transaction in the special mode assures that the transactions in the special mode negative remote crediting are completed even though a particular transaction has remained incomplete. Given a completed transaction in the special mode, the special flag is reset.

Additionally, time monitoring by the control unit of the postage meter machine is undertaken during the execution of a transaction in the special mode which takes effect if a predetermined execution time is exceeded or given a transaction that has remained incomplete in order to carry out the transaction to its end.

Time monitoring likewise ensues on the part of the data center when a transaction is undertaken in the special mode for negative remote crediting. The register data of the postage meter machine can be centrally checked when communication is again established, for conducting a re mote crediting in order, for example, to reload a credit. Either the postage meter machine again automatically enters into the communication, if the transaction remains incomplete, in order to finish the transaction to its end, or an authorized service transmission provides the data center with a message before the end of the day regarding the current status of the postage meter machine, for the purpose of annulling the data transmitted in the special mode negative remote crediting. Otherwise, the time monitoring of the part of the data center results in recognition of the data transmitted in the special mode for negative remote crediting after the expiration of the predetermined time spank.

In a second version, security is enhanced by checking the operating sequence for coincidence with a predetermined operating sequence in the postage meter machine and by a check of the crediting request in the data central for coincidence with a code stored therein for a predetermined crediting request. It is possible to time-dependently modify the operating sequence, with the same calculating algorithm being employed in the data center and in the postage meter machine in order to identify a current operating sequence. Transmission of a valid operating sequence from the data center to the postage meter machine is thus superfluous.

In a third version, security is enhanced by a combination of a number of measures. A discriminateable log-on at the data center ensues in a first transaction and a predetermined crediting request was stored in the data center and in the postage meter machine in a first transaction. As a reaction thereto, the data center communicates a new security flag and/or a predetermined operating sequence for lateral entry into the special mode negative remote crediting to the postage meter machine is the postage meter machine was normally, activated and has entered into the communication connection. A check is made in the data central to determine whether the communicated crediting request corresponds to a predetermined crediting request. In the first transaction, for example, a new code word or security flag and/or operating sequence is communicated to the postage meter machine and, in a second transaction, the logged-on transaction is implemented and, corresponding to the crediting request, a credit value is added in the corresponding memory of the postage meter machine as well as in a corresponding memory of the data center for the purpose of checking the transaction.

For an entry into the special mode for negative remote crediting, the service technician must implement the operating sequence during the turn-on of the postage meter machine in the way communicated to him from the data center, i.e. a specific key combination must be simultaneously pressed with turn-on of the machine.

In the second transaction, the reloading of the postage meter machine according—the corresponding crediting value—ensues with a negative credit, so that a remaining credit of zero arises as a result.

The inventive procedure also recognizes that the funds stored in the postage meter machine must be protected against unauthorized access. Falsification of data stored in the postage meter machine is made more difficult to such an extent that the effort is no longer rewarding for a manipulator.

Commercially obtainable OTP processors (one time programmable) can contain all security-related program parts in the inside of the processor housing, and can also contain the code for forming the message authentication code (MAC). The MAC is an encrypted checksum that is attached to a data block (or blocks). For example, data encryption standard (DES) is suitable as a crypto-algorithm. MAC information can thus be attached to the relevant security flags and to the special flags, or to the registered data and thus enhances the difficulty of manipulation of the aforementioned flags or of the postal registers.

The method for improving the security of a postage meter machine of the type capable of communicating with a remote data center and having a microprocessor as part of its control system, also includes the steps of forming a check sum in the OTP processor regarding the content of the external program memory and comparison of the result to a predetermined value stored in the OTP processor. This can occur in the execution of the franking mode or the operating mode, particularly during the initialization (i.e., when the postage meter machine is started) or at times when printing is not carried out (i.e., when the postage meter machine is being operated in standby mode). In case of an error, a logging and subsequent blocking of the postage meter machine then ensue.

In order to improve the security of postage meter machines against manipulation, a distinction is made between non-manipulated and manipulated operation of a postage meter machine using the control system of the postage meter machine by monitoring the time duration of the execution of programs, program parts or security-associated routines during the operating mode, and by comparing the measured run time with a predetermined run time following the execution of the monitored programs, program parts or security-associated routines. A manipulation with fraudulent intent should thus also be prevented during a communication, particularly by undertaking monitoring in the communication mode as to the adherence to a specific time sequence in the special mode for negative remote crediting. The time duration is monitored starting from sending a third encrypted message on the part of the postage meter machine to the reception of the fourth encrypted message sent from the data central to the postage meter machine which trigger, given verification, a zeroizing of the credit value. A decremental counter or an incremental counter is employed in order to detect a transgression of the time in the special mode as a reliable indication for an abortive transmission, and a specific sub program is then called that prepares a renewed implementation of the special mode for negative remote crediting and automatically triggers it, so that the first and second transaction are automatically repeated.

In a fourth version, security is enhanced by an additional input security units that is brought into contact with the postage meter machine in order to transfer a remaining credit from an authorized person back to the data center.

DESCRIPTION OF THE DRAWINGS

FIG. 6 is a block illustration of an executive sequence with two transactions for reloading with a negative credit in accordance with the principles of the present invention.

DESCRIPTION OF THE PREFERRED EMBODIMENTS

Figure 1:
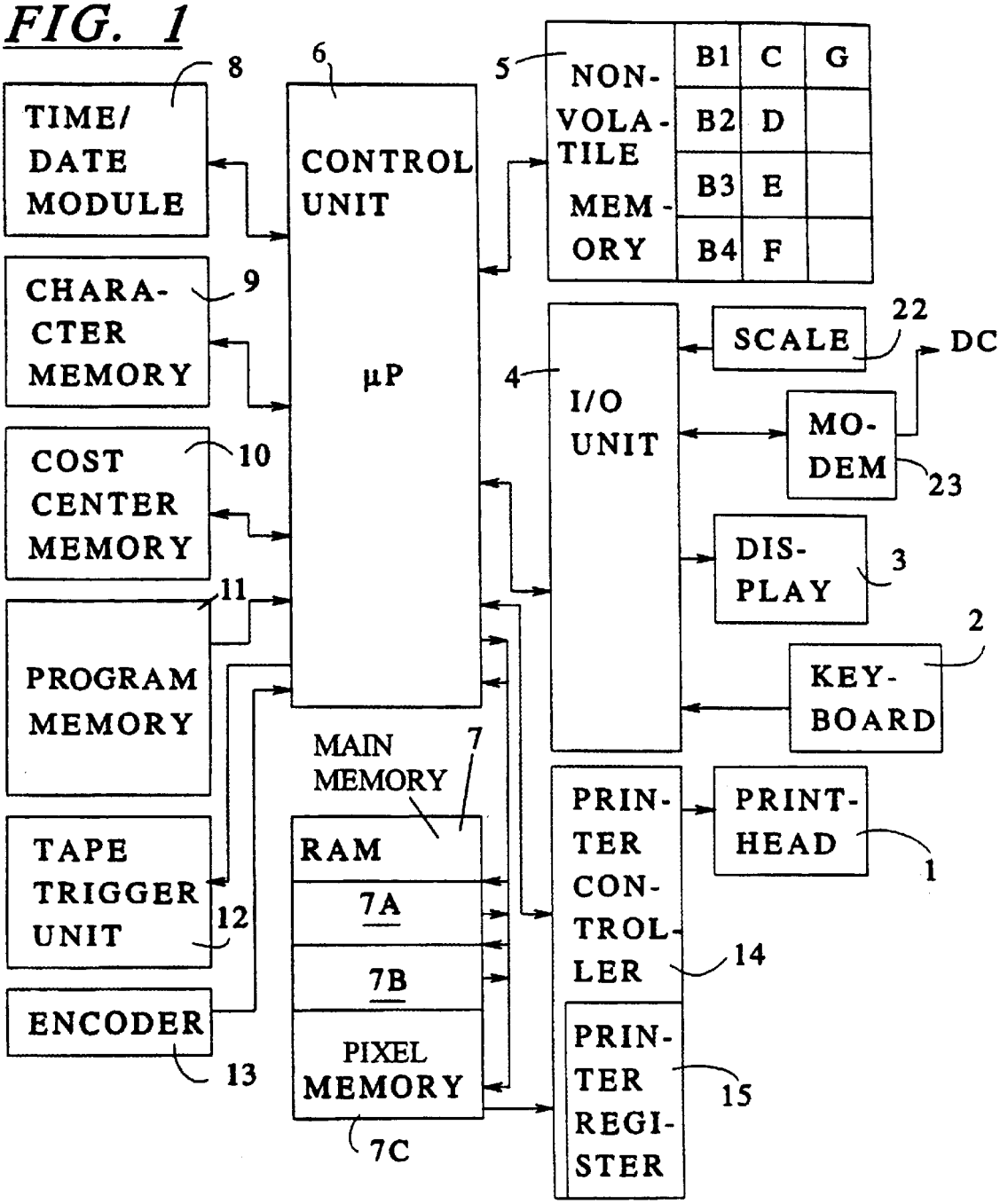
FIG. 1 is a block circuit diagram of a postage meter machine constructed in accordance with the principles of the present invention.

FIG. 1 shows a block circuit diagram of the inventive postage meter machine FM with a printer module 1 for a fully electronically generated franking format, having at least one input unit 2 having a number of actuation elements, a display unit 3 and a modem 23 that sets up the communication to a data central. These units are coupled via an input/output control module 4 to a control unit 6, having a non-volatile memory 5 for the variable parts of the franking format and a non-volatile memory 11 for the constant parts of the franking format.

A character memory 9 supplies the necessary printing data to a volatile main memory 7. The control unit 6 has a microprocessor $\mu$P that is in communication with the input/output control module 4, the character memory 9, the volatile main memory containing memory regions 7A, 7B and 7C, of which region 7C is a pixel memory and with the non-volatile main memory 5, with a cost center memory 10, a program memory 11, the motor of a conveyor or a feeder unit, a tape trigger unit 12 (if provided), an encoder (coding disk) 13 as well as with a clock/date module 8. The individual memories can be realized a number of physically separated modules or can be combined in a few modules (not shown) which are secured against removal by at least one additional measure, for example by being glued on the printed circuit board, by sealing or by casting with epoxy resin.

Figure 2:
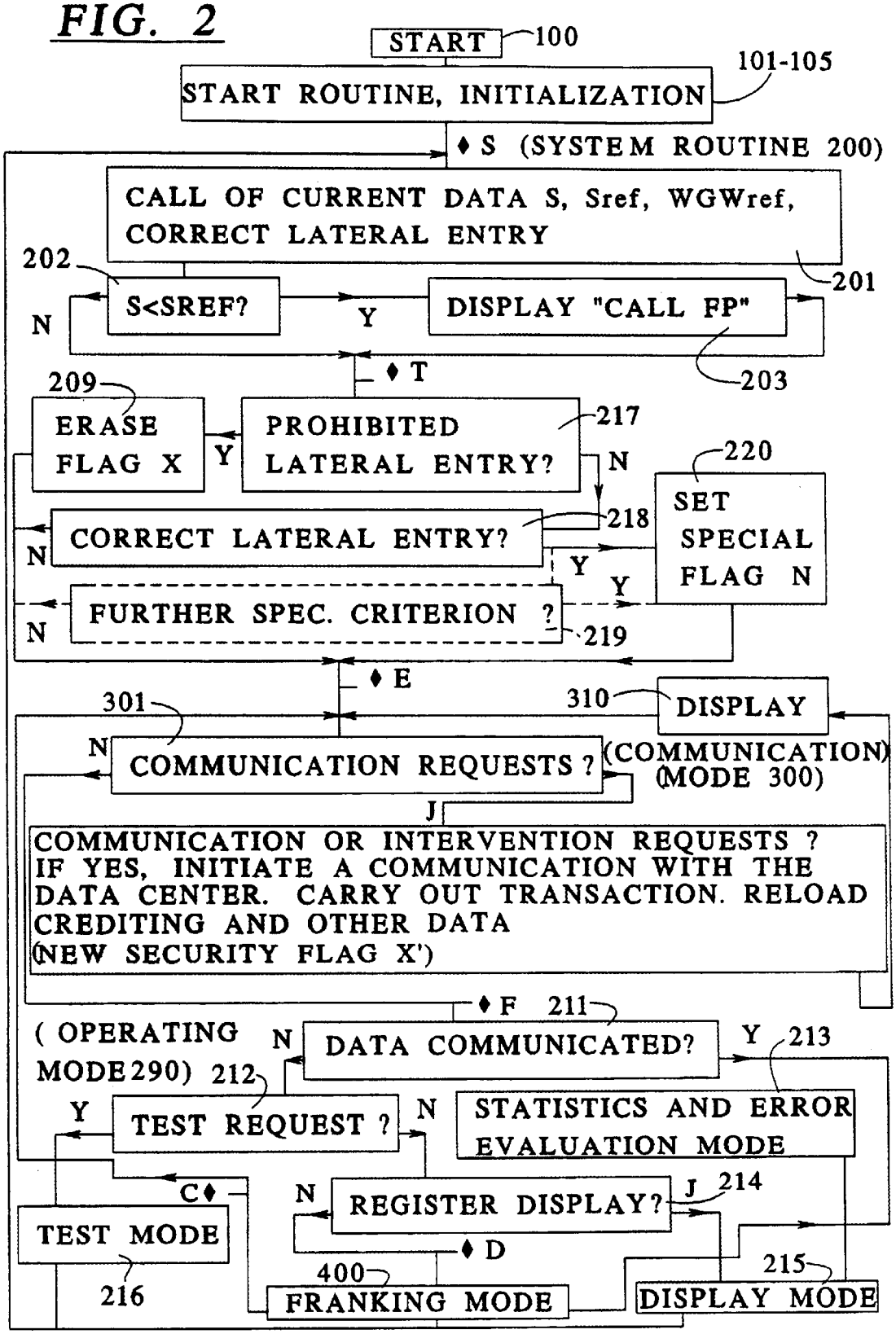
FIG. 2 is a flowchart of a method for operating the postage meter machine of FIG. 1 in accordance with the principles of the present invention.

FIG. 2 shows a flowchart for a postage meter machine FM as shown in FIG. 1 with a security system according to a preferred version of the invention.

After the postage meter machine FM is turned on in step, start 100, a function check with following initialization is undertaken within a start routine 101.

Figure 7:
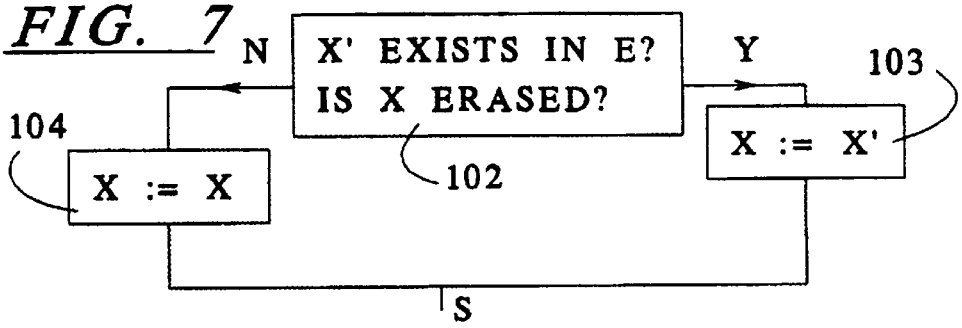
FIG. 7 is a flowchart for storing a security flag or code word in accordance with the principles of the present invention.

As shown in greater detail in FIG. 7, this step also includes a number of sub-steps 102 through 104 for storing a security flag or code word. If, according to step 102, a new security flag X' exists in another, predetermined memory location E of the non-volatile memory 5, this new security flag X' is copied into the memory location of the old security flag X in a step 103 in case a valid security flag X is no longer a present stored therein. This occurs in the case of an authorized as well as an unauthorized intervention because the old security flag X is erased at every intervention. Erasure of the security flag X may also have occurred due to entry into the kill mode. If a valid security flag X is no longer stored, a postage value can not be printed in the franking mode 400. A new code word has not been communicated given the absence of intervention. In this case, copying is not undertaken and the old security flag X remains saved in the memory after step 104. Subsequently, the system routine 200 is reached with point S.

The system routine 200 includes a number of steps 201 through 220 of the security system. In step 201, current data are called, as set forth below in conjunction with the invention for a second mode, namely for the sleeping mode. As shown in FIG. 2, a check is made in step 202 to determine whether the criteria for entry into the sleeping mode are met. When this is the case, a branch is made to step 203 in order to display at least one warning with the display unit 3. If the criteria for entry into the sleeping mode are not met, the program proceeds directly to point T.

If a prohibited lateral entry (step 217) is found, the aforementioned security flag X is erased. The security flag X can be a MAC-protected security flag or an encrypted code. The check for validity of the security flag X in, for example, step 409 of a franking mode 400 is implemented with a selected check sum method within an OTP (one time programmable) processor that internally contains the corresponding program parts and also stores the code for forming a MAC (message authentication code), for which reason the manipulator cannot, replicate the type of check sum method. Further security-associated crypto-data and executions are stored only in the inside of the OTP processor, for example in order to supplement crypto-data with the new key transmitted from the data center DZ to the postage meter machine FM so that the crypto-data supplemented in this way can be used to undertake an encryption of messages that are communicated to the data center DZ. The same security-associated crypto-data or executions allow a security "cover" to be placed over the postal registers.

Figure 4:
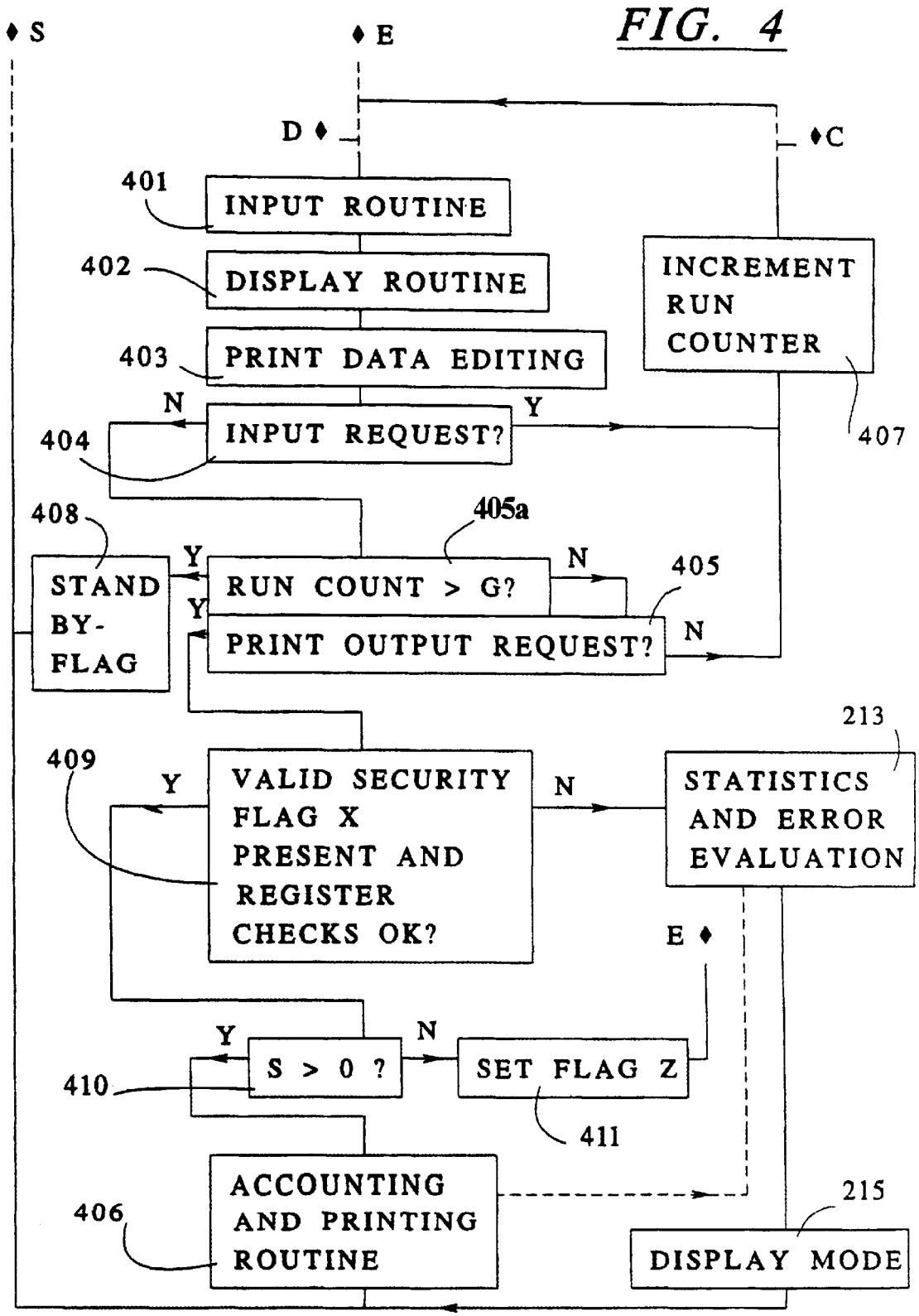
FIG. 4 is a flowchart for the franking mode according to a preferred version of the invention.

A further security version that operates without an OTP processor makes it more difficult to locate the key by the coding thereof, and storage of different parts thereof in respectively different memory areas. A MAC is again appended to each data set in the security-relevant registers. A manipulation of the registered data can be recognized by monitoring the MAC. This routine ensues in step 406 in the franking mode that is shown in FIG. 4. Manipulation at the postal register can thus be made maximally difficult.

Figure 3A:
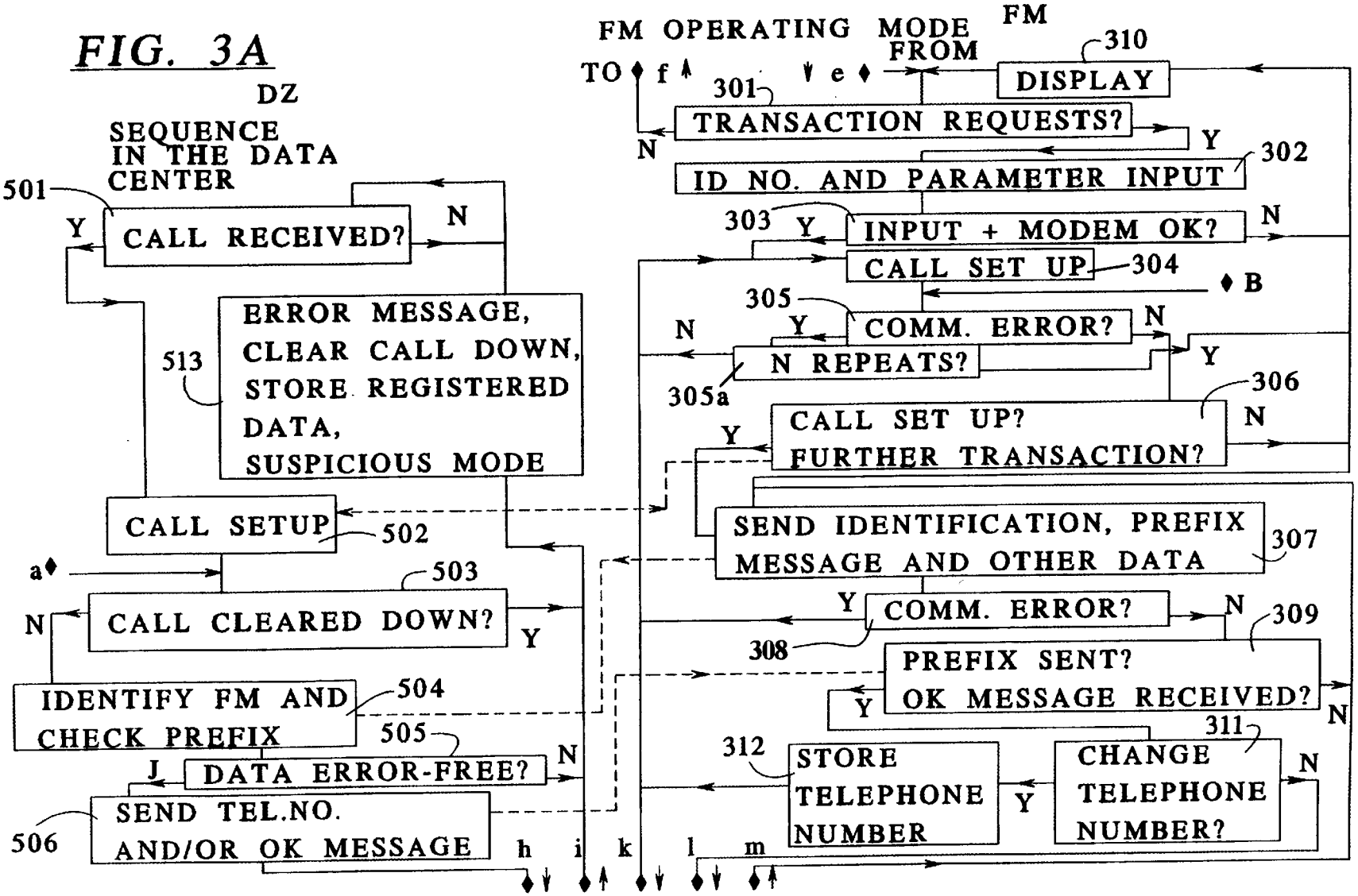
FIGS. 3*a* and 3*b* illustrate the security executions of the postage meter machine of FIG. 1 and the data center in the communication mode in accordance with the principles of the present invention.

After a check in step 217, whereby a relevant deficiency is found and the security flag X was erased in step 209, the point e, i.e. the be ginning of a communication mode 300, is reached and an interrogation is made in step 301—shown in FIGS. 2 and 3*a* as to whether a transaction request is present. When this is not the cease, the communication mode 300 is exited and point f, i.e. the operating mode 290, is reached. If relevant data were communicated in the communication mode, then a branch is made to step 213 for data evaluation. If non-communication was found in step 211, a branch is to be made to step 212. A check is now made to determine whether corresponding entries have been actuated in order to proceed into the test mode 216 given a test request 216, or to proceed into a display mode 215 if a check of the register readings is to be made (step 214). If this is not the case, point d, i.e. the franking mode 400, is automatically reached.

In case of a manipulation, step 213 for statistics and error evaluation is reached. The display mode 215 is reached via step 213 and a branch is then made back to the system routine. When inhibited, the branch to the franking mode, 400 can no longer be implemented. It is also inventively provided that a statistics and error evaluation is implemented in step 213 in order to acquire further current data which, after branching to the system routine 200, can likewise be called in step 201, for example for an aforementioned second mode or some other special mode.

A number of further interrogations after satisfying further criteria for further modes can lie between the points s and t of the system routine 200. Further details regarding an interrogation following a first mode that serves the purpose of preventing printing or inhibiting the postage meter machine FM are disclosed in U.S. Pat. No. 5,805,711, the teachings of which are incorporated here in by reference. As disclosed herein, if the postage meter machine FM housing is to be opened by a person authorized to do so, a written or telephone application to the data center DZ for an authorized opening is made which communicates the opening date and the approximate time of day of the opening. Before the postage meter machine FM can then be opened, a communication with the data center DZ must be undertaken via modem in order to request the opening authorization and in order to load a new code X' that can replace the old code X.

Differing therefrom in the inventive procedure, the presence of the security flag X is not interrogated between the points s and t but only in step 409 in the franking mode. As a result, the service technician—after loading the new security flag X'—can nonetheless restore full functionability of the postage meter machine. FM subsequently even after an erasure of the aforementioned flag X. For example, this also allows a check to be implemented to determine whether an unauthorized action in fact leads to the erasure of the security flag or code word or whether the erasure was prevented by manipulation.

Figure 8:
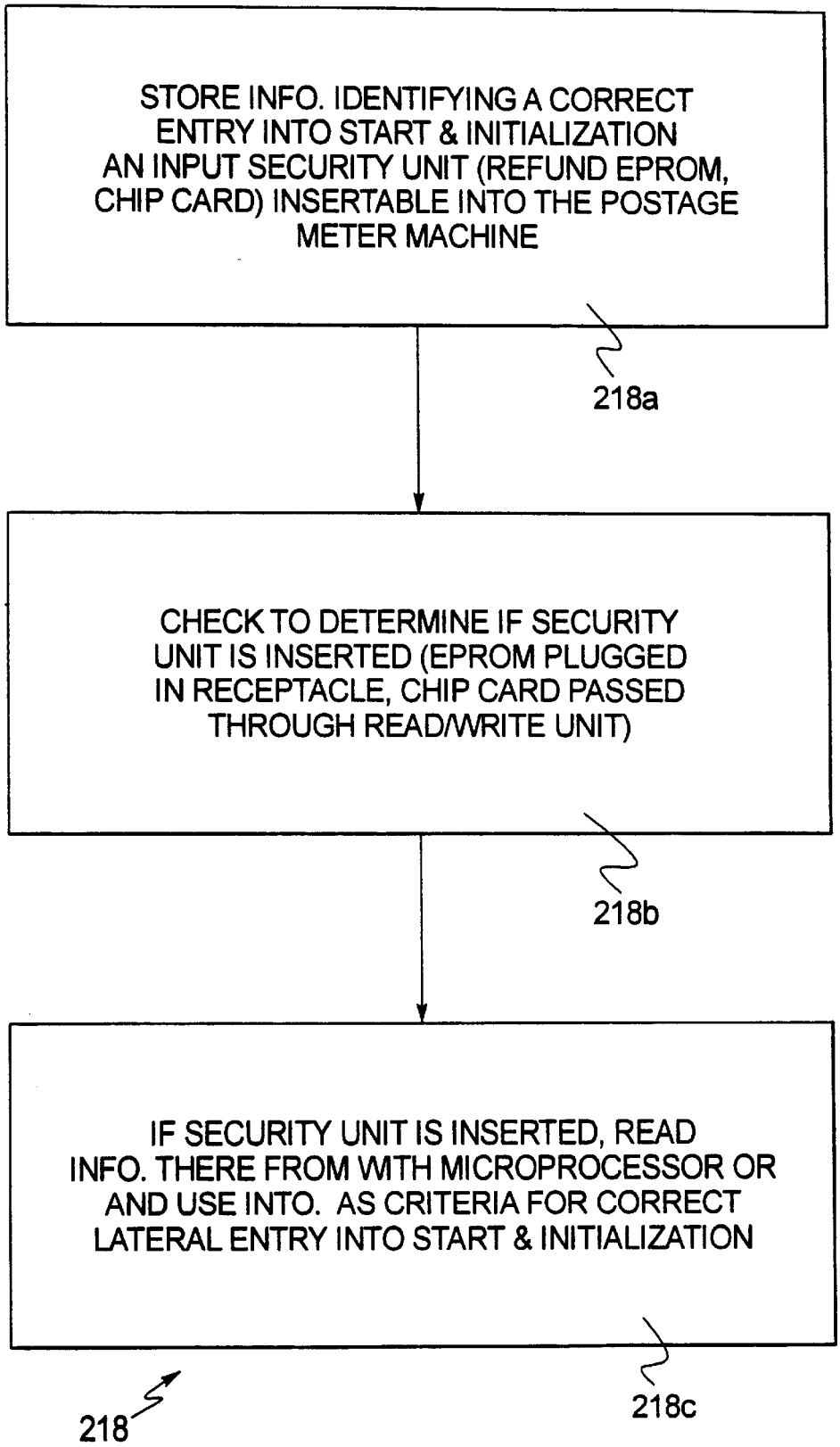
FIG. 8 is a flowchart for determining whether a correct lateral entry was in the flowchart of FIG. 2.

Given an authorized service action, a finding is made in step 217—shown in FIG. 2—that no prohibited lateral entry had been implemented. A check is undertaken in step 218 to determine whether a correct lateral entry has been made. FIG. 8 illustrates how this determination can be made. In step 218*a*, information is stored in an input security unit which identifies a correct entry into the start and initialization routine. The security unit is insertable into the postage meter machine, and may be a refund EPROM which is pluggable into a receptacle in the postage meter machine, or a chip card which is passed through a chip card read/write unit. In step 218*b*, a check is made to determine if the security unit is inserted, i.e., whether the EPROM has been plugged into the receptacle, or whether the chip card has passed through the read/write unit. If the security unit is inserted, in step 218*c* the information is read therefrom with the microprocessor, and this information is used as criteria for a correct lateral entry into the start and initialization routine. Such an interrogation criterion is likewise provided in order, for example in step 212, to recognize whether an operating action was undertaken in order to proceed into a test mode. Given an allowed lateral entry that is not the correct lateral entry for the special mode of a negative remote crediting for the purpose of returning funds from the postage meter machine FM to the data center DZ, a branch is made to point e of the system routine 200. Otherwise, given correct lateral entry, a branch is made to step 220 in order to set a special flag for the entry into the special mode. In another embodiment, a further interrogation step 219 may be provided preceding the step 220 in order, using a further criterion, to further enhance security against unauthorized calling of the special mode, whereby a branch is made to point e of the system routine 200 given non-satisfaction of the criterion. For example, the interrogation step 219 shown in FIG. 2 can interrogate a further criterion such as whether the identification number (ID number or PIN) was entered. As a result of the other protections against unauthorized lateral entry, security is already adequately high, so that such additional, further criteria interrogations can be foregone if simpler operation is desired. Another possibility in the interrogation step 219 is shown with dashed lines in FIG. 2. In this option, a further criterion is interrogated as to whether the same predetermined crediting request was made at least n-times and a corresponding remote value was added to the remaining credit. This can be a zero crediting request that leads to the transmission of a zero credit value and that can be added to the remaining value without the total of the stored credit being modified.

In order to further enhance the security against manipulation, the special flag N set in step 220 for the special mode is likewise a MAC-protective flag No The security is additionally enhanced by a check in the data center DZ to determine whether a predetermined crediting request had been communicated from the postage meter machine FM. The communicated crediting request is evaluated in the data center DZ in code to implement a very specific transaction. The communicated crediting request can be evaluated, in the data center DZ in code in order to allow a return of funds. Otherwise, the communicated crediting request can be evaluated in the data center DZ in code to allow a transmission for a security flag X or for a code word X.

Figure 3B:
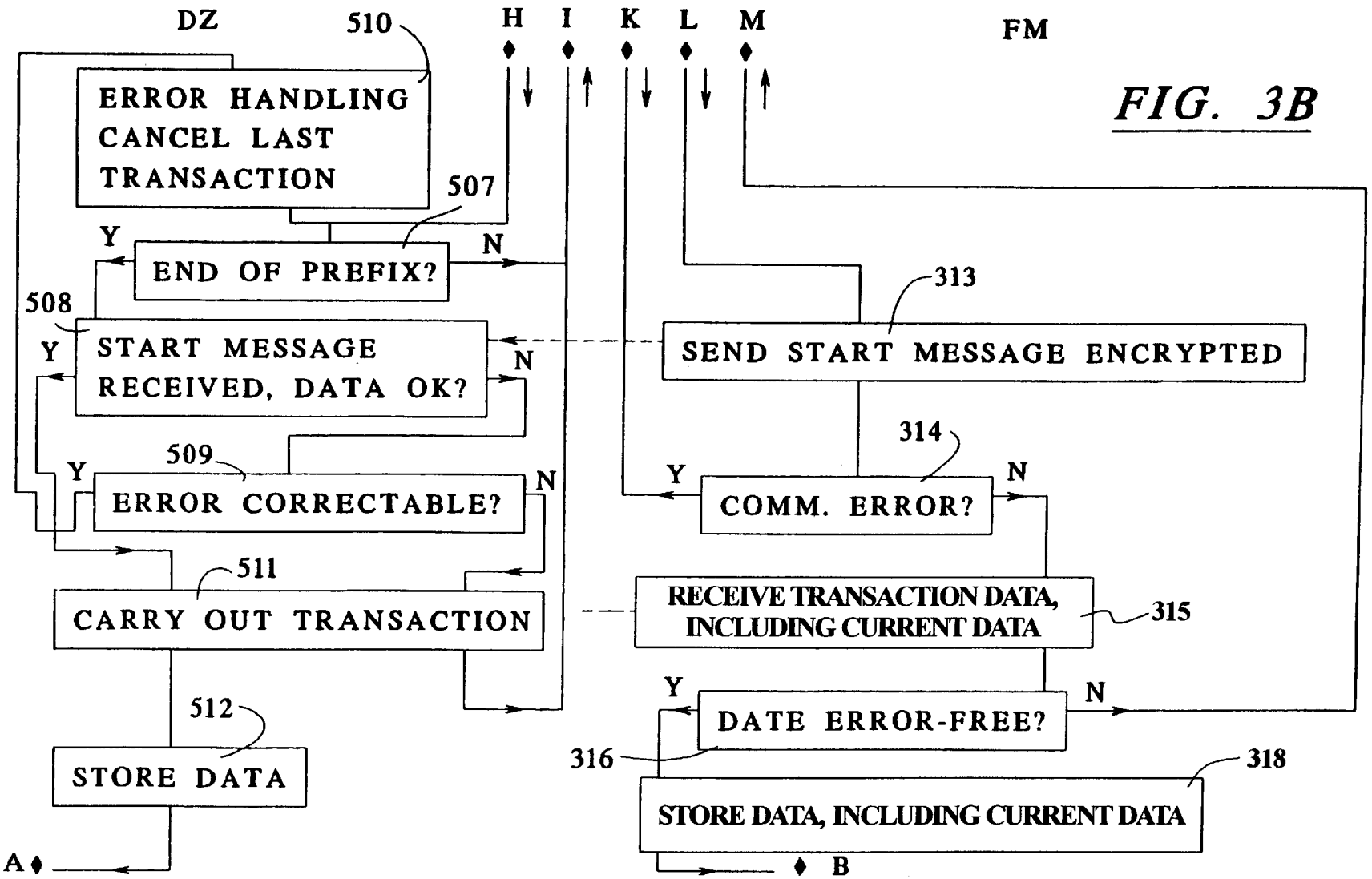

FIGS. 3*a* and 3*b* illustrate the operation of the security sequences of the postage meter machine FM in the communication mode and the security procedure of the data center DZ in the communication mode.

When point e, i.e. the beginning of the communication 300 explained below, is reached, an interrogation is made in a step 301—shown in FIGS. 2 and 3*a*—as to whether a transaction requests present. Such a request can have been made for credit reloading, change of telephone number and the like.

The user selects the communication or remote crediting mode of the postage meter machine FM by entering the identification number (8-place postage fetching number). It is then assumed, for example, that the return of funds in an amount corresponding to the amount remaining in the postage meter machine FM is to ensue. A register interrogation of the descending register R1 that contains the remaining amount stored ensues first. After the postage meter machine FM is turned off, the lateral entry into the special mode is undertaken upon reactivation. After the entry of the identification number, the entry is confirmed with the teleset key (T key) and the crediting request is entered in the amount of the previously interrogated remaining value. As a result of the lateral special mode entry, the crediting request is automatically interpreted as a credit value to be subtracted. The crediting request is confirmed by actuating the teleset key. Since the remaining value is also interrogated by the data center DZ in every communication, a comparison of the two, i.e. the remaining value and the crediting request, can thus ensue in the data center DZ. Otherwise, the aforementioned entries can be automatically implemented by the postage meter machine FM in a preferred version in order to simplify operation.

For example, a communication is to ensue in order to load a new security flag X' that can replace the old security flag X. When such a transaction request is then made, the crediting amount must be modified because, of course, the credit in the postage meter machine FM is not to be replenished in this case. A value other than zero, however, can be agreed upon, particularly a value that corresponds only to a minimum amount by which the descending register value would have to be replenished.

FIG. 3*a* shows that part of the communication of a transaction that is undertaken with encrypted messages. Nonetheless, these messages can contain data that are MAC-protected, for example the identification number of the postage meter machine FM.

As noted above, an inquiry is made in step 301 as to whether a transaction request is present. If not, a branch is made to point F. If so, the program proceeds to step 302. In step 302, entry of the identification number (ID number) and of the intended input parameters can ensue in the following way. The ID number can be the serial number of the postage meter machine FM, a PIN or a PAN (postage fetching number) that is acknowledged by actuation with the predetermined T-key of the input unit 2. The input parameter (crediting value) used in the most recent remote crediting (replenishment) appears in the display unit 3, this now being overwritten or retained by the entry of the desired input parameter. The input parameter is a numerical combination that is interpreted in the data center DZ as a request, for example to communicate a new security flag or code word, when an intervention authorization had been previously obtained. Given an incorrect entry of the aforementioned input parameter, the display can be erased by pressing the C-key.

When, for example, a modification is entered in order to load a credit having the value zero in a transaction but an intervention authorization was not previously obtained, the input parameter thus serves only as a new crediting value. The credit for frankings is, however, neither raised in terms of value when the input parameter has the value zero nor is a new security flag loaded. Nonetheless, a piece number X' can be communicated at every communication, as taught in the aforementioned U.S. Pat. No. 5,805,711.

Only on the basis of prior communication, for example with a separate call to the data center DZ or in some other form of communication, is the data center DZ informed that a new security flag X' is to be communicated to the postage meter machine FM when a transaction for the value zero is subsequently started on the part, of the postage meter machine FM within a predetermined time span. The request for intervention is only considered as having been made when the postage meter machine FM enters into the communication mode declared in this way after the log-on of an authorized intervention.

If, however, an arbitrarily different input parameter is agreed upon with the data center DZ, a reloading of the credit corresponding to the input crediting value is effected as the result of a second transaction upon entry of this input parameter in addition to effecting the communication of a new security flag X' corresponding to the pre-agreed code that is formed by the predetermined crediting request.

When an input parameter other than that agreed upon is entered, the result is merely a reloading in the amount of the selected, new crediting amount, but differing from the other transaction data, the crediting, amount need not be communicated to the postage meter machine FM. The fact that a valid transaction was verified is adequate for the postage meter machine FM in order to undertake a replenishment or reduction of the descending register content by the crediting amount corresponding to the stored crediting request.

When the requested input parameter is correctly displayed, this is confirmed by another actuation of the predetermined T-key of the input unit 2. An illustration corresponding to a change of input parameter or corresponding to the non-modification thereof (old crediting value) then appears in the display unit 3.

By actuating the predetermined T-key, the modification of the input parameter is started via the modem connection. The input checks (step 303) and the further procedures sequence automatically, accompanied by a corresponding display.

To that end, the postage meter machine FM checks in step 303 whether a modem is connected and operational. When this is not the case, a branch is made to step 310 in order to indicate that the transaction request must be repeated. Otherwise, the postage meter machine FM reads the selection parameters (main/extension, etc.) and the telephone number from the NVRAM memory area F and sends these together with a selection request command to the modem 23. Subsequently, the call setup required for the communication via the modem 23 to the data center DZ ensues in a step 304.

The executive sequence ensuing parallel thereto in the data central that is required for the communication is likewise shown in FIG. 3*a* in the left half thereof. A constant check is carried out in step 501 to determine whether a call has ensued in the data central. When this is the case and the modem 23 has selected the communicating partner, the call setup in the data central also ensues parallel in step 502. In step. 503, further, a constant monitoring is undertaken to determine whether the connection to the data central has been cleared. When this is the case, a return branch to step 501 ensues after an error message in step 513.

Parallel thereto, monitoring is carried out in the postage meter machine FM in step 305 to determine whether communication errors have occurred. If so a branch is made through step 305*a* back to step 304 in order for the postage meter machine FM to set up the connection again. If a predetermined number N of unsuccessful dial repeats is noted in step 305*a* for the purpose of a call set-up, a branch is made back to the point e via a display step 310. If no identifiable error was present in step 305, the postage meter machine FM proceeds to step 306 to determine whether the connection has been set up and whether a transaction is yet to ensue. If so, a branch is made to step 307 in order to send an opening message or identification, prefix or registered data, and if not a branch to point e via the display step 310 is made. The same check as in step 305 is implemented in the following step 308, i.e. a branch is made back to step 304 given the occurrence of a communication error. Otherwise, an opening message is sent from the postage meter machine FM to the data center DZ. Contained therein, among other things, are the postage fetching number for identifying the calling party, i.e. the postage meter machine FM, at the data center DZ.

If in step 503 it was determined that the connection to the data center DZ has not been cleared, the opening message is checked for plausibility in the data center DZ in step 504 and is further interpreted by making another check subsequently in step 505 to determine whether the data were communicated error-free. If this is not the case, a branch is made back to step 513 for an error message. If the data are error-free and it is recognized in the data center DZ that the postage meter machine FM has made a reloading request, then a reply message to the postage meter machine FM is sent as a prefix in step 506. A check is made in step 507 to determine whether the prefix message including prefix end was sent in step 506. If this is not the case, then a branch is made back to step 513.

A check is made in the postage meter machine FM in step 309 to determine whether a prefix was sent by the data center DZ as a reply message in the meantime, was received. If this is not the case, a branch is made back to step 310 for display and a transaction request is subsequently interrogated again in step 301. If a prefix was received and the postage meter machine FM has received an "okay" message, a check of the prefix parameters in view of a change of telephone number ensues in step 311. If an encrypted parameter was communicated, there is no change of telephone number and a branch is made to step 313 in FIG. 3*b*.

FIG. 3*b* shows an illustration of the security sequences of the postage meter machine FM in a communication mode and, parallel thereto, those in the data center DZ.

In step 313, a start message is sent encrypted from the postage meter machine FM to the data center DZ. In step 314, the message is checked for communication errors. When a communication error is present, a branch is made back to step 304 and another attempt is made to set up the connection to the data central in order to send the start message in encrypted form.

This encrypted start message is received by the data center DZ when the prefix message has been completely sent in step 506 and the end of prefix had been identified in step 507. In step 508, a check is made in the data center DZ to determine whether this start message was received and to determine whether the data are in acceptable form. If this is not the case, a check is made in setup 509 to determine whether the error can be eliminated. If the error cannot be eliminated, a branch is made to step 513 after an error message was communicated from the data control DZ to the postage meter machine FM. Otherwise, an error handling is implemented in step 510 and a branch is made to step 507. If the reception of acceptable data was found in step 508, the data center DZ begins to implement a transaction in step 511. In the aforementioned example, if not communication error is found in step 314 at least the identification number is transmitted to the postage meter machine FM with an encrypted message, the postage meter machine FM receiving the transaction data, including the current date, in step 315.

In the following step 316, the data are checked. If an error is present, a branch is made back to step 310. Otherwise, storage of the same, aforementioned data as in the postage meter machine FM ensues in the data center DZ in step 512. In step 318, thus, the transaction is terminated in the postage meter machine FM with the data storage, including the current date. Subsequently, a branch is made back to step 305. If no further transaction is to ensue, step 310 is reached for display and, thereafter, step 301.

If a transaction request is then not made, a check is made in step 211 according to FIG. 2 to determine whether, data have been communicated. If data were communicated, step 213 is reached. Corresponding to the input request, the postage meter machine FM places the current crediting request or the new code word Y' or other transaction data in, for example, memory area E of the non-volatile memory 5.

If, however, a numerical combination other than zero is entered as an input parameter in step 302 and the input was "okay" (step 303), a call set up ensues (step 304). When a connection set-up without errors (step 305) is present (step 306), an identification and prefix message is sent to the data center DZ. Among other things, the postage fetching number PAN for the identification of the postage meter machine FM is again contained in this opening message at the data center DZ. The data center DZ recognizes from the entered numerical combination—when the data are error free (step 505)—that, for example, a credit having a crediting value is to be replenished in the postage meter machine FM.

If, in the meantime, the current telephone number of the data center DZ has changed, measures must be undertaken to store this in the postage meter machine FM. In step 506, a reply message having the elements change of telephone number and current telephone number is transmitted in unencoded form from the data center DZ. The postage meter machine FM, which receives this message, recognizes in step 311 that the telephone number is to be modified. A branch is now made to step 312 in order to store the current telephone number. Subsequently, a branch is made back to step 304. When the connection has nonetheless been set up and a communication error is not present (305), a check is subsequently made in step 306 to determine whether a further transaction is to ensue. If this is not the case, a branch is made via step 310 to step 301. The communication of the telephone number can likewise ensue MAC-protected.

After the storage of the current telephone number has ensued, the postage meter machine FM automatically sets up a new connection to the data central using of the new telephone number. The actual transaction intended by the user, a remote crediting of the new security flag X' or a communication of an encrypted message suitable for verification for reloading the remaining credit corresponding to a crediting request, is thus automatically implemented, i.e. without a further intervention by the user of the postage meter machine FM. A corresponding message appears in the display that the connection is automatically set up again on the basis of the changed telephone number.

After an intervention, the postage meter machine FM is switched into the communication mode 300. The authorized party can also subsequently inform the data center DZ of the end of the test. A communication can include a storage of the telephone number as well as a credit reloading or return of funds (refund). A number of transactions can thus be implemented without interrupting the communication.

When the amount of the credit to be reloaded is to remain the same as in the last credit reloading, only one transaction is necessary.

If, however, the amount of the credit to be reloaded is changed, two transactions are required. The two transactions ensue in a comparable way.

A successful transaction thereby sequences as follows: The postage meter machine FM sends its ID number and a crediting value for the amount of the requested reloading credit, possibly together with a MAC, to the data center DZ. The latter checks such a communicated message with the MAC in order to then send an "okay" message —likewise MAC-protected—to the postage meter machine FM. The "okay" message no longer contains the crediting value.

The communication of a new security flag X' or of relevant data for a modification of the amount of credit in the postage meter machine FM ensues in encrypted form but the communication of the telephone number ensues in unencrypted form. The use of a MAC protection, however, is likewise possible. If it is found in the data center DZ that the connection to the postage meter machine FM was cleared (step 503) or that faulty data (step 505) or errors (step 509) that cannot be eliminated are present or that no prefix end was sent (step 507), the communication is ended. After an error message, the communication connection is cleared, the storing of the communicated data and the interpretation thereof ensue in step 513 on the part of the data center DZ.

During a first transaction, at least one encrypted message is communicated to the data central as well as to the postage meter machine FM. The crediting request is contained only in the encrypted message of the first transaction. Every communicated message that contains security-associated transaction data is encrypted. For example, the DES algorithm can be used for the encrypted messages.

A transaction request leads to a specifically protected credit reloading in the postage meter machine FM. Such protection preferably ensues for the postal registers present outside the processor in the cost center memory 10, also ensuing during the credit reloading with a time control. If the postage meter machine FM, for example, is analyzed with an emulator/debugger, then it is probable that the communication and accounting routines will not sequence within a predetermined time. When this is the case, i.e. the routines will require substantially more time, and a part of the DES key is thus modified. The data center DZ can determine this modified key during a communication routine with register interrogation and can subsequently report the postal meter machine as suspect as soon as a start message is transmitted encrypted according to step 313.

If it is found in the data central in step 509 that the error cannot be eliminated, the data center DZ cannot implement a transaction (step 511) because a branch was made back to step 513. Since no data were received in the postage meter machine FM in step 513, the transaction has not ensued error-free (step 316). A branch is thus made back via step 310 to step 301 in order, after a display, to check again whether a transaction request continues to be made.

If this is not the case, the communication mode 300 is left and the point f, i.e. the operating mode 290, is reached. Thus no data could be communicated in the above-discussed case with modified. DES cipher (step 211). It is likewise assumed that neither a test request (212) nor a register call (214) was initiated in order to check the remaining credit. Then, however, the franking mode 400 is reached.

Given an authorized intervention, the inventive security approach assumes the reliability of the authorized person (service, inspector) and the possibility of checking for their presence. Checking the seal and checking the register readings in an inspection of the postage meter machine FM and, independently thereof, checking the data in the data center DZ provides the inspection security. The checking of the franked postal mailings upon incorporation of a security imprint provides an additional security review.

The postal meter machine implements the registered check regularly and/or when turned on and thus can recognize the lacking information if an unauthorized intervention into the machine occurred, or if the machine was serviced in unauthorized fashion. The postal meter machine is then inhibited. Without the invention in combination with a security flag X, the manipulator could easily overcome the inhibit. In this way, however, the security flag X is lost and it would then cost the manipulator too much time and expense to identify the valid MAC-protected security flag X or code word by trial and error. In the meantime, the postage meter machine FM would long have been registered as suspect in the data center DZ.

Other versions, or a combination with other versions, such as, for example, the erasing of a part of the VES cipher or of the redundant register readings or erasing other data or ciphers that are of significance for the data center DZ in a transaction can be included in the inventive procedure. It is important that critical program parts are stored in the OTP and the program run time monitoring means are components of the OTP in terms of software and/or hardware. The critical programs stored in the program memory 11 externally from the OTP can thus be monitored with these program parts. This achieves the advantage that the monitoring program itself cannot be observed or manipulated since it constantly remains in the OTP and cannot be read out.

A suitable processor for the inventive apparatus and procedure, for example, in the TMS 370 C010 of Texas Instruments that has a 256 byte $E^2$ PROM. Security-associated data (ciphers, flags, etc.) can thus be stored manipulation-proof in the processor.

If a manipulator undertakes an unauthorized intervention, the postage meter machine FM effectively will be prevented from franking with a postage value due to being converted into the first mode.

A would-be postage meter machine FM manipulator must overcome a number of thresholds to attempt to defeat the inventive security measures, requiring a certain time expenditure. If no communication from the postage meter machine FM to the data central occurs within certain time intervals, the postage, meter machine FM already becomes suspect. It is thereby to be assumed that the person who perform a manipulation at the postage meter machine FM will be unlikely to report to the data center DZ.

During an inspection, the seal of the postage meter machine FM is first checked to see if it is intact and the register readings are then checked. As warranted, a specimen imprint with a zero franking value can be made. Given repair by a service technician on site, operations may possibly be performed on the postage meter machine FM. The error registers, for example, can be read out with the assistance of a specific service EPROM that is plugged-in place of the advert (advertisement) EPROM. If the processor does not access this EPROM plug-in location, access to the data lines is usually prevented by specific driver circuits that are not shown in FIG. 1. The data lines, which can be reached through a sealed housing door, can thus not be contacted in unauthorized fashion. Another service-related procedure is the read out of the error register data by a service computer connected via an interface. For preparing for the intervention, the registers of the postage meter machine FM are interrogated in order to identify the type of required intervention. Before an operation is performed on the postage meter machine FM and the housing is opened, a separate call to the data center DZ ensues. When the credited value is modified to zero thereafter within a predetermined time span and is communicated to the data center DZ within the framework of a transaction, i.e. the type of intervention and the registered data were communicated to the data center DZ, a communication of data from the data central to the postage meter machine FM ensues (corresponding to an authorized, requested intervention) into the postage meter machine FM that is logged as a permissible intervention.

If, within a predetermined time span, however, the credited value is modified to a value differing from zero and is communicated to the data center DZ within the framework of a transaction, the previous separate call to the data central is without consequence, i.e. a request for intervention is considered as not having been made and an authorization for authorized intervention into the postage meter machine FM is not granted and, consequently, a new security flag or new code word X' is not communicated.

The postage meter machine FM is capable of distinguishing between requested authorized and unauthorized intervention into the postage meter machine FM by means of the control unit 6 of the postage meter machine FM in combination with the data communicated from the data center DZ. To this end, given an unauthorized intervention into the postage meter machine FM, this operation is logged as an error but, following an ensuing authorized intervention into the postage meter machine FM, the original operating condition is restored with the aforementioned, communicated data.

The explanation of the execution sequences after the franking mode shown in FIG. 4 ensues in conjunction with the flowchart shown in FIG. 2. During times wherein printing is not occurring (standby mode), an interrogation ensues with regard to attempted manipulations and/or the check sum of the register readings and/or of the content of the program memory 11 is formed. The aforementioned check sum is deposited in the non-volatile memory 5 (memory area E of the NV-RAM) MAC-protected by the manufacturer of the postage meter machine FM. For checking the content of the program memory 11, the check sum is recalculated and a MAC is formed using a stored cipher that has remained unmodified. The aforementioned cipher is a manipulation-protected (non-readable) cipher. The old MAC-protected check sum is now read from the NV-RAM 5 and is compared to the newly calculated MAC-protected check sum in the OTP. For improving the security against manipulation, the check sum in another version for a kill mode is formed in the processor over the content of the external program memory 11 and the result is compared to a predetermined value stored in the processor. This preferably ensues in step 101 when the postage meter machine FM is started or in step 213 when the postage meter machine FM is operated in the standby mode. The standby mode is reached when a predetermined time has elapsed without an input or a print request. The latter is the case when a letter sensor (of a known type and thus not shown) does not identify a next envelope to be franked. The step 405 shown in FIG. 4 of the franking mode 400 therefore also includes a further interrogation of the time lapse or of the number of passes through the program loop (each pass increments a run counter in step 407) which ultimately leads back to the input routine according to step 401. The input routine step 401 is followed by a display routine in step 402 and a print data editing routine in step 403. When the interrogation criterion is satisfied, a standby flag is set in step 408 and a branch is made directly back to the point s to the system routine 200 without the accounting and printing routine being run in step 406. The standby flag is interrogated later in step 211 and is reset after the check sum check in step 213 when no attempted manipulation is recognized.

The interrogation criterion in step 211 is expanded for this purpose by determining whether the standby flag is set, i.e. Whether the standby mode has been. reached. In this case, a branch is likewise made to step 213. In a preferred version, the security flag X is erased in as already set forth if an attempted manipulation in the standby mode has been identified in the aforementioned way in step 213. The especially protected special flag N can likewise be checked in step 213, particularly when it is MAC-protected, by comparing the flag content to the MAC content. The lack of the security flag X is recognized in the interrogation step 409 and a branch is their made to step 213. The advantage of this method in combination with the first mode is that the attempted manipulation is statistically acquired in step 213.

FIG. 4 shows the flowchart for the franking mode according to a preferred embodiment. The invention assumes that, after turn-on, the postal value in the value imprint is automatically set corresponding to the last entry before the turn-off of the postage meter machine FM and the date in the postmark is automatically set to the current date by the clock/date module 8. For imprinting, the variable data are electronically embedded into this fixed data for the frame and with all other data that have remained unmodified.

The numerical strings that are entered for generating the input data with the input unit (keyboard) 2 or from an electronic scale 22, that is connected to the input output unit 4 and calculates the postage value, are automatically stored in memory area D of the non-volatile main memory 5. Moreover, data sets of the sub-memory areas, for example $B^j$, C, etc. are preserved. It is thus assured that the last-entered quantities are preserved even in the case of turn-off of the postage meter machine FM, so that the postage value in the value imprint is automatically set after turn-on to agree with the last input before turn-off of the postage meter machine FM, and the date in the postmark is set to the current date.

When a scale 22 is connected, the postage value is taken-from the memory area D. In step 404, a wait ensues until such a currently stored postage value is present. Given another input request in step 404, a branch is made back to step 401. Otherwise, a branch is made to step 405 in order to wait for the print output request. The letter to be franked is detected by a letter sensor and a print request is thus triggered. A branch can thus be made to the accounting and printing routine in step 406. If no print output request (step 405) is present, a branch is made back to step 301 (point e).

Since, according to the embodiment shown in FIG. 4, a branch, is made back to point e and step 301 is reached, a communication request can be made at any time or some other entry can be actuated corresponding to the steps of test request 212, register check 214, input routine 401.

A further interrogation criterion (i.e., run or loop count) can be used in step 405*a* in order to set a standby flag in step 408 if a print output request is not present after a predetermined number G of runs through the loop. As set forth above, the standby flag can be interrogated in the step 211 following the communication mode 300. A branch is thus not made to the franking mode 400 before the check sum check has shown the full complement of all or of at least selected programs.

When a print output request is recognized in step 405 (which necessarily means the run count in step 405*a* did not exceed G), further interrogations are actuated in the following steps 409 and 410 as well as in step 406. Criterion such as the presence of a valid security flag X or a corresponding MAC-protected flag X or reaching a further B piece count are interrogated in step 409 and/or, in step 406; the registered data utilized for accounting are interrogated in known way. If the criteria interrogated in step 409 are present, a determination is then made in step 410 as to whether the permitted, predetermined piece count S of franked items was consumed in the preceding franking. If the piece count S now is equal to zero, flag Z is set in step 411 and a branch is automatically made to point e in order to enter into the communication mode 300, so that a new, predetermined piece count S can be credited again by the data center DZ. If, however, the predetermined piece count S has not yet been reached, a branch is made from step 410 to the accounting and printing routine in step 406.

The number of printed letters and the current values in the postal registers are registered in an accounting routine 406 in the non-volatile memory 10 of the postage meter machine FM are available for later interpretation. A specific sleeping mode counter is initiated to count one count more during the accounting routine that ensues immediately before printing.

The register values can be interrogated as needed in the display mode 215. It is also possible to print out the register values with the printer head of the postage meter machine FM for accounting purposes. This, for example, can ensue as set forth in greater detail in the aforementioned U.S. Pat. No. 5,805,711.

In a further embodiment, variable pixel image data are also embedded into the remaining pixel image data during printing. Corresponding to the position report supplied by the encoder 13 regarding the feed of the postal matter or paper strip relative to the printer module 1, the compressed data are read from the main memory 5 and are-converted with the assistance of the character memory 9 into a print format comprised of binary-pixel data that are stored in volatile working memory 7, likewise in such a decompressed form. Further details are disclosed in European Applications EP 576 113 and EP 578 042.

The pixel memory area in the pixel memory 7*c* is thus provided for the selected, decompressed data of the fixed parts of the franking format and for the selected, decompressed data of the variable parts of the franking format. The actual printing routine ensues after the accounting (in step 406). As proceeds from FIG. 1, the main memory 7*b* and the pixel memory 7*c* are in communication with the printer module 1 via a printer controller 14 having a printer register 15 and output logic. The pixel memory 7*c* has an output side connected to a first input of the printer controller 14, which has further control inputs at which output signals of the microprocessor controller means 6 are present. When all columns of a print format have been printed, a branch is made back to the system routine 200.

The communication of a new piece count S can then ensue in the same fashion as was set forth in conjunction with the communication of the new security flag X'. In a communication according to FIGS. 3*a* and 3*b*, a new, predetermined piece count S' is then communicated and is decremented as piece count S in the ongoing franking. The comparison piece count $S_{ref}$ is calculated internally from the new, predetermined piece count S' (step 213). A warming (CALL FP) can thus be emitted in step 203 before the piece count of zero is reached. The user of the postage meter machine FM is thus requested to communicate with the data central in order to at least undertake a zero remote crediting for recrediting of at least the piece count S.

Figure 5:
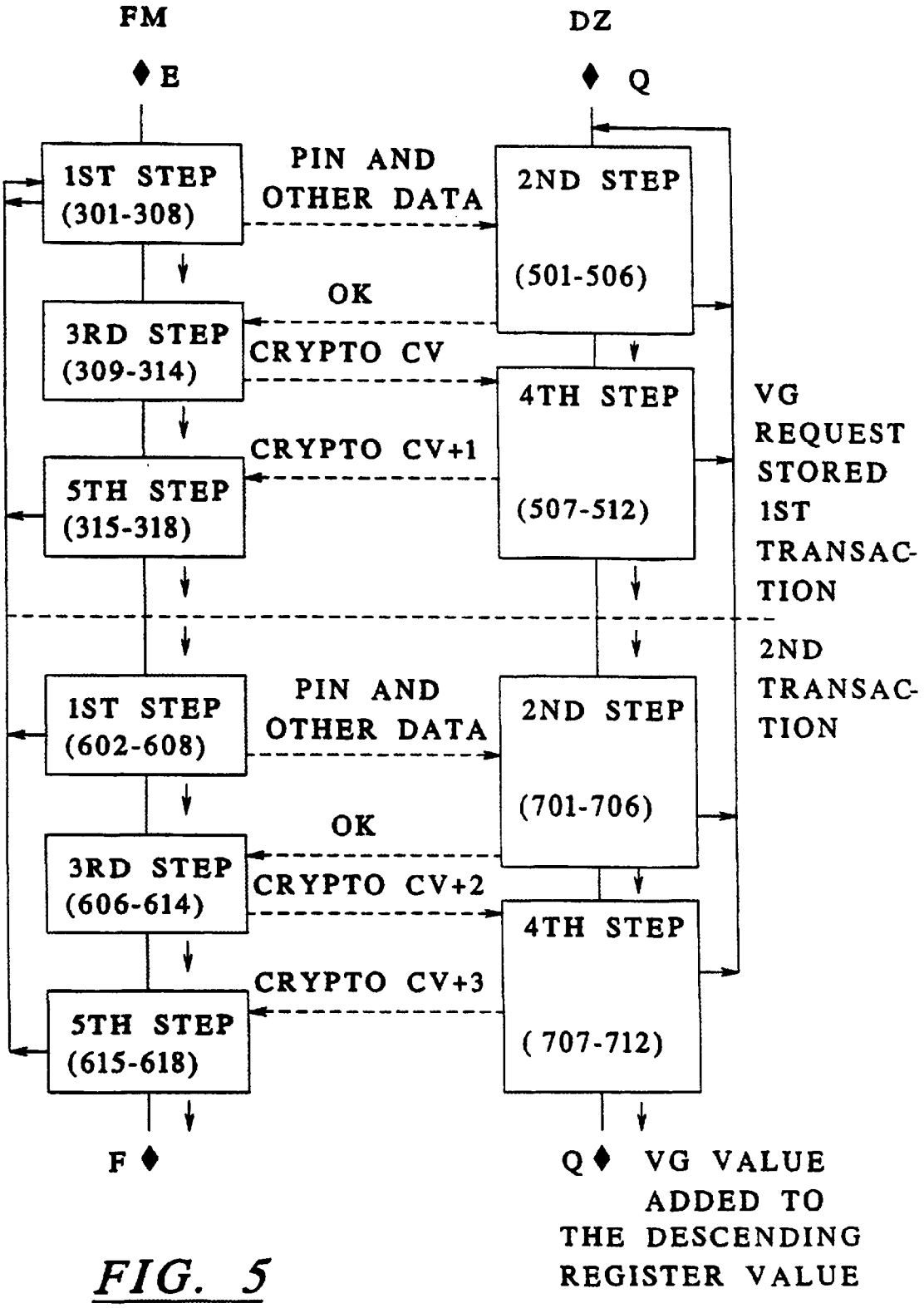
FIG. 5 is a general block illustration of an executive sequence with two transactions for reloading with a zero credit in accordance with the principles of the present invention.

The executive sequence with two transactions for reloading with a credit value, preferably with a zero credit value, is shown simplified in FIG. 5. Such a zero remote crediting always includes two transactions.

The first transaction of a communication with the data center DZ is the communication of a predetermined crediting request. A zero crediting request is suitable for producing the consistency of the register readings between the data center DZ and the postage meter machine FM. During a second transaction, this leads to a zero credited value that can be added to the descending register value without modifying the value of the remaining credit.

Given a normal entry into the communication mode, the system routine 200 is interrogated in step 218 after the turn-on of the postage meter machine FM—shown in FIG. 2—to determine whether the user has implemented a correct lateral entry. If this is not the case, a branch is made to point e of the system routine 200. A message regarding establishing the communication appears on the display upon entry of the PIN and pressing of the teleset key (T-key). Additionally, the previous credited value is displayed, this being able to be overwritten by the new crediting request NULL. After the zero input, the T-key is again actuated. There is then a transaction request and the communication can be implemented.

The first step during a first transaction after entry into the communication mode (positive remote value crediting or, respectively, teleset mode) is a sub-step 301 for checking for a transaction request that has been made and followed by sub-steps 302 through 308 for entering the identification and other data in order to set-up the communication connection and for communication with encrypted data in order to transmit at least identification and transaction type data to the data center DZ.

The first step of the first transaction including sub-steps 301 through 308 of the postage meter machine FM to set up the connection, communicate with unencrypted data and to transmit at least identification, transaction type and other data to the data center DZ. The transaction type data (1 byte) includes the communication to the data central DZ following the teleset mode for a requested, positive remote crediting with the identified postage meter machine FM.

A second step of the first transaction includes sub-steps 501 through 506 in the data central for the reception of data and for checking the identification of the postage meter machine FM, as well as for communicating an encrypted "okay" message to the postage meter machine FM. The second step of the first transaction also includes sub-steps in order, given faulty, unencoded messages noted in step 505, to branch via a sub-step 513 for an error message to acquiescent condition q in the sub-step 501 in the data center DZ until the communication on the part of the postage meter machine FM has been re-assumed.

A third step of the first transaction includes sub-steps 309 through 314 of the postage meter machine FM for forming a first encrypted message crypto cv with a first cipher Kn stored in the postage meter machine FM and for the transmission of encrypted data to the data center DZ, containing at least the crediting request, identification and postal register data. In a further embodiment of the inventive security measures, this encrypted message also contains data in the form of CRC (cyclic redundancy check) data. The crediting request, the identification, postal register and other data such as, for example, a check sum (CRC data) are transmitted in a communication encrypted with the DES algorithm.

A fourth step of the first transaction that includes sub-steps 507 through 511 in the data center DZ is provided for the reception and for the decryption of the first encrypted message. A check for determining whether decryption has occurred is implemented with a key stored in the data center DZ. Given a successful outcome, a calculation for forming a second cipher Km+1 is undertaken in the data center DZ, corresponding to the cipher used by the postage meter machine FM. Subsequently, a second encrypted message crypto Cv+1 is formed, containing at least the aforementioned, second cipher Kn+1, the identification and the transaction data, whereby the DES algorithm again being utilized for encryption. In conclusion, a transmission of the second, encrypted message crypto Cv+1 to the postage meter machine FM occurs.

Further sub-steps serve the purpose, given identification of faulty encrypted messages that cannot be corrected, to branch in sub-step 509 via a sub-step 513 for error reporting to a quiescent condition 501 in the data enter until the communication on the part of the postage meter machine FM is re-assumed. Further sub-steps are provided in order, given faulty, encrypted messages identified in sub-step 509 that, however, have errors that can be eliminated, to branch to a sub-step 510 for canceling the prior transaction and in order to subsequently branch to the sub-step 511 in the data center DZ. This sub-step 511 serves the purpose of forming a second cipher kn+1 that should be communicated encrypted to the postage meter machine FM, for forming a second encrypted message crypto Cv+1, and for transmitting the encrypted communication to the postage meter machine FM. The fourth step of the first transaction also includes a sub-step 512 of the data center DZ for storing the crediting request from which a branch is made to the first sub-step 701 of the second step of the second transaction in order to store the first cipher Kn as a predecessor cipher and the second cipher Kn+1 as successor cipher.

A fifth step of the first transaction that includes sub-steps 315 through 318 of the postage meter machine FM serves the purpose of receiving and decrypting the second encrypted message, extracting at least the identification data and the transmitted, second cipher $Kn+1_{Cv+1}$, as well as for verifying the received, encrypted message on the basis of the extracted identification data. Given verification, the transmitted, second cipher $Kn+1_{Cv+1}$ and the crediting request are stored in the postage meter machine FM. Otherwise, given non-verification, a branch is made back to the first step of the first transaction.

After this pre-synchronization of the data center DZ by the postage meter machine FM, a second transaction begins that is preferably initiated by an additional, manual entry instep 602. As a result of this chronologically limited input a triggering of the second transaction ensues or the second transaction in the communication mode is departed when the input time has been exceeded. The T-key must preferably be actuated within thirty seconds or the input time is transgressed and a branch is made back to the first step of the first transaction. The communication can be omitted or repeated as needed.

A first step of the second transaction includes sub-steps 602 through 608 at the postage meter machine FM for communication with encrypted data in order to set up the connection and in order to transmit at least identification and transaction type data to the data center DZ. A second step of the second transaction that includes sub-steps 701 through 706 at the data center DZ is provided for receiving the data and for checking the identification of the postage meter machine FM, as well as for communicating an encrypted "okay" message to the postage meter machine FM. The second step of the second transaction includes sub-steps in order, given faulty, encrypted messages noted in step 705, to branch via a sub-step 513 for error reporting to a quiescent condition 501 in the data center DZ until the communication on the part of the postage meter machine FM has been re-assumed.

A third step of the second transaction includes sub-steps 609 through 614 at the postage-meter machine FM for forming a third encrypted message crypto Cv+2 with the aforementioned second cipher Kn+1 stored in the postage meter machine FM and for transmission of the third encrypted message crypto Cv+2 to the data center DZ, including at least identification and postal register data but without data for a credited value.

A fourth step of the second transaction that includes sub-steps 707 through 711 at the data central for the reception and for decryption of the third encrypted message crypto Cv+2 conducted for checking this message for decryptability with a cipher stored in the data center DZ. A formation of a third cipher Kn+2 then ensues which should be communicated encrypted to the postage meter machine FM, plus the formation of a fourth encrypted message crypto Cv+3 that contains at least the aforementioned third cipher Kn+2, the identification and the transaction data, and the transmission of the fourth encrypted message crypto Cv+3 to the postage meter machine FM.

The fourth step of the second transaction includes sub-steps in order, given faulty, encrypted messages that cannot be eliminated (sub-step 709), to branch via a sub-step 513 for error reporting to a quiescent condition 501 in the data center DZ until the communication on the part of a postage meter machine FM has been re-assumed. Given detection in a step 709 of faulty, encrypted messages with errors that can be eliminated, a branch is made to step 710 for canceling the prior transaction. Following thereafter in sub-step 711 in the data central, is a formation of a third cipher Kn+2 is formed that should be communicated encrypted to the postage meter machine FM. For forming a fourth encrypted crypto-message Cv+3, the DES algorithm is again utilized. Subsequently, a transmission of the crypto-message to the postage meter machine FM ensues.

The fourth step of the second transaction for storing the credited value also includes a sub-step 712 of the data center DZ that branches to the first sub-step 501 of the second step of the first transaction in order to store the second cipher Kn+1 as predecessor cipher Kn−1 as successor cipher Kn+2 as successor cipher kn for further first and second transactions.

A fifth step of the second transaction, which includes sub-steps 615 through 618 at the postage meter machine FM, serves the purpose of receiving and decrypting the fourth encrypted message, extracting at least the identification data and the transmitted, third cipher $Kn+2_{Cv+3}$ as well as the transaction data, and verifying the received, encrypted message on the basis of the extracted identification data. Given verification, the transmitted, second cipher $Kn+2_{Cv+3}$ and the credited value are added to the descending register value R1 correspondingly in the postage meter machine FM and the resultant credit is stored, given non-verification, a branch is made back to the first step of the first transaction.

Either a return is made to the first step in order to effect a further initiation of the transaction or, in the fifth step of the second transaction, the aforementioned transaction attempts are in turn canceled.

A negative remote crediting in the special mode differs from this NULL remote crediting in the communication mode primarily on the basis of a specific manipulation-proof flag and a time monitoring. Such manipulation-proof flags are, in particular, a MAC-protected security flag X and a MAC-protected special flag No.

FIG. 6 shows the executive sequence with two transactions for reloading with a negative credit value, i.e. a negative remote crediting for returning funds to the data central. Such a negative remote crediting comprises at least two transactions. The first transaction of a communication with the data center DZ is the communication of a predetermined crediting request, preferably a NULL crediting request, in order to produce consistency of the register readings between the data center DZ and the postage meter machine FM.

The first step during a first transaction following a defined lateral entry into the special mode negative remote crediting, compared to a normal entry into the communication mode (teleset mode) after the turn-on of the postage meter machine FM, is a sub-step 301 for checking for a transaction request that has been made. This is followed by further sub-steps 302 through 308 for entering identification data and other data in order to set up the communication connection and for communication with an unencrypted message in order to transmit at least identification and transaction type data to the data center DZ. A protection of individual data in the message can again be achieved with a MAC with CRC data in the aforementioned way.

The defined lateral entry is achieved by pressing a secret, predetermined key combination during the turn-on of the postage meter machine FM. The control unit 6 of the postage meter machine FM can, in conjunction with the data communicated earlier from the data center DZ and an input procedure, distinguish between authorized action (service technician) and unauthorized action (manipulative intent).

Given authorized action, a special flag N is set in step 220 since, if the postage meter machine FM is switched off, the continuation of the transaction after the reactivation of the postage meter machine FM must be secured. As protection against manipulation, the special flag N is likewise stored non-volatile MAC-protected.

When a mis-attempt or when some other key combination is entered for the lateral entry attempt, this is interpreted as unauthorized action or as an attempted manipulation (error message) and is stored and step 209 for preventing further franking is triggered.

A predetermined key combination is stored in the data center DZ for each postage meter machine FM and is only communicated to the authorized person (service technician) in order to achieve a predetermined operating sequence at the postage meter machine FM. The correct lateral entry effects a message on the display regarding setting up communication.

For switching the postage meter machine FM into a special mode, a flag N, protected against manipulation, is set in step 220 if a specific criterion is present in satisfactory form, the specific criterion for the special mode negative remote crediting comprising at least the execution of the predetermined key combination for lateral entry into the special mode during the activation of the postage meter machine FM.

In one embodiment, as an in the positive remote crediting, an entry of the PIN and pressing of the teleset key (T-key), then a zero entry and pressing the T-key are implemented before the communication. The communication with the data center DZ comprises at least two transactions that are repeatedly run in case of error, whereby, following an interruption, the communication is automatically reassured and/or is implemented as long as the aforementioned special flag N for the special mode is set, with which an automatic transaction request is made in order to complete the return of the credit.

A first step of the first transaction includes sub-steps 301 through 308 at the postage meter machine FM in order to set up the connection, to communicate with unencrypted data, and to transmit at least identification, transaction type and other data to the data center DZ. The transaction type data (1 byte) comprises the message to the data center DZ, following the special mode, of a desired negative remote crediting with the identified postage meter machine FM.

A second step of the first transaction includes sub-steps 501 through 506 in the data center DZ for receiving data and for checking the identification of the postage meter machine FM, as well as for communicating an unencrypted "okay" message to the postage meter machine FM. The second step of the first transaction also includes sub-steps in order, given faulty, unencrypted messages noted in step 505, to switch via a sub-step 513 for error reporting to a quiescent condition 501 in the data center DZ until the communication on the part of the postage meter machine FM has been re-assumed.

A third step of the first transaction includes sub-steps 309 through 314 of the postage meter machine FM for forming a first encrypted message crypto cv with a first cipher Kn stored in the postage meter machine FM and for transmission of encrypted data to the data center DZ, comprising at least the crediting request, identification and postal registered data. In a further embodiment of the security measure, this encrypted message comprises—in the form of CRC (cyclic redundancy checked) data—the communication to the data central DZ following the special mode of a requested, negative remote crediting. The cyclic redundancy check comprising two bytes is a check sum that allows a manipulation of data processed to form the check sum to be recognized. This check sum can include individual data or the components of all messages (transaction type) on the part of the postage meter machine FM. The crediting request, the identification, postal register and the CRC data are then communicated in a message encrypted with the DES algorithm. It is thus not required to transmit data in the first step to the data center Dzin an MAC-protected or encrypted form.

A fourth step of the first transaction that includes sub-steps 507 through 511 in the data center DZ for the reception and for the decrypting of the first encrypted message or the check thereof for decryptability with a cipher stored in the data center DZ, for forming a second cipher Kn+1 corresponding to the cipher used by the postage meter machine FM, for forming a second encrypted message crypto Cv+1 (that contains at least the aforementioned second cipher Kn+1, the identification data and the transaction data), and for transmitting the second encrypted message crypto Cv+1 to the postage meter machine FM. The fourth step of the first transaction also includes sub-steps in order, given faulty encrypted messages noted in step 509 that cannot be corrected, to branch via a sub-step 513 for error reporting to.a quiescent condition 501 in the data center DZ until the communication on the part of a postage meter machine FM has been re-assumed. Sub-steps are also provided in order, given faulty, encrypted messages noted in step 509 with errors that can be eliminated, to branch to a step 510 for canceling the prior transaction and to subsequently branch to the sub-step 511 in the data center DZ. This sub-step serves the purpose of forming, a second or third cipher Kn+1 that is to be communicated in encrypted form to the postage meter machine FM, for forming a second encrypted messages crypto Cv+1, and for transmitting the encrypted message to the postage meter machine FM. Further, the fourth step of the first transaction includes a sub-step 512 of the data center DZ for storing the crediting request from which a branch is made to the first substep 701 of the second step of the second transaction in order to store the first cipher Kn as predecessor cipher and the second cipher Kn +1 as successor cipher.

A fifth step of the first transaction which includes sub-steps 315 through 318 serves the purpose of receiving and decryptofying the second encrypted message, of extracting at least the identification data and the transmitted, second cipher $Kn+1_{Cv+1}$, as well as for verifying the received, encrypted message on the basis of the extracted identification data. Given verification, the transmitted, second cipher $Kn+1_{Cv+1}$ and the crediting request are stored in the postage meter machine FM. Otherwise, given non-verification, a branch is made back to the first step of the first transaction.

After this pre-synchronization of the data center DZ by the postage meter machine FM, a second transaction ensues. A first step of the second transaction includes sub-steps 602 through 608 of the postage meter machine FM for communication with unencrypted data in order to setup the connection and in order to transmit at least identification and transaction type data to the data center DZ.

A second step of the first transaction which includes the sub-steps 701 through 706 at the data center DZ is provided for receiving the data and for checking the identification of the postage meter machine FM as well as for communicating an unencrypted "okay" message to the postage meter machine FM. It is also provided that the second step of the second transaction comprises sub-steps in order, given a faulty encrypt message being noted in step 705, to branch via a sub-step 513 for error reporting to a quiescent condition 501 in the data center DZ until the communication of the part of the postage meter machine FM has been re-assumed.

A third step of the second transaction includes sub-steps 609 through 614 at the postage meter machine FM for forming a third encrypted message crypto Cv+2 with the aforementioned second cipher Kn+1 stored in the postage meter machine FM, and for transmitting the third encrypted message crypto Cv+2 to the data center DZ, comprising at least identification and postal registered data but without data for a credited value.

A fourth step of the second transaction which includes sub-steps 707 through 711 of the data central, for the reception and for the decryptofication of the third encrypted message crypto Cv+2 leads to the chain thereof for decryptability with a cipher stored in the data center DZ. This is followed by formation of a third cipher Kn+2 that is to be communicated encrypted to the postage meter machine FM, a formation of a fourth encrypted message crypto Cv+3 that contains at least the aforementioned third cipher Kn+2, the identification and the transaction data, and the transmission of the fourth encrypted message crypto Cv+3 to the postage meter machine FM.

The fourth step of the second transaction includes sub-steps in order, given faulty encrypted messages noted in step 701 that cannot be corrected, to branch via a sub-step 513 for error reporting to a quiescent condition 501 in the data center DZ until the communication of the part of the postage meter machine FM has been re-assumed. Given faulty encrypted reengages identified in a step 709 having errors that can be corrected, a branch is made to a step 710 for canceling the prior transaction. This is followed in the data center DZ in sub-step 711 via formation of a third cipher Kn+2 that is to be communicated encrypted to the postage meter machine FM. The DES algorithm is again utilized for forming a fourth encrypted message crypto Cv+3. This is followed by transmission of the encrypted message to the postage meter machine FM.

The fourth step of the second transaction for storing the credited value includes a sub-step 712 of the data center DZ that branches to the first sub-step 501 of the second step of the first transaction in order to store the second cipher Kn+1 as predecessor cipher Kn−1 and the third cipher Kn+2 as successor cipher Kn for further first and second transactions.

A fifth step of the second transaction that includes sub-steps 615 through 618 at the postage meter machine FM serves for receiving and for decrypting the fourth encrypted message, for extracting at least the identification data and the transmitted, third cipher $Kn+2_{Cv+3}$ as well as the transaction data, as well as for verifying the received encrypted message on the basis of the extracted identification data. The aforementioned step includes a further interrogation criterion for identification of the completed implementation, differing from the positive remote crediting. The postage meter machine FM should have received the fourth crypto message within a predetermined time beginning with the transmission of the third crypto message. If the communication is not interrupted, the reception would ensue in the predetermined time t1.

In the preferred embodiment, thus, the last and particularly important portion of the second transaction is monitored for transgression of the time t1. The possible manipulation time is thus highly limited. To this end, a time count is started during the penultimate message to be transmitted, beginning with the transmission of the crypto-message, being started in the processor, (control unit 6) of the postage meter machine FM. This is preferably achieved by means of the corresponding program segment activating a routine which sets a counter that in turn is decremented by the system clock pulse or a multiple thereof. A number of counters are cascaded in order to be able to monitor a longer time span, for example on the order of magnitude of 10 seconds. When the fourth crypto-message from the data center DZ reaches the postage meter machine FM within the critical time span, the counter is deactivated. If, by contrast, this last crypto-message fails to arrive, the counter continues to be decremented. When the count limit is reached by the counter, a program interrupt signal is triggered. This signal initiates the calling of a special sub-program that prepares and triggers a renewed transaction. The communication of the postal register contents is again a component of this renewed transaction. A consistency check which takes place in the data central leads to the recognition that an incomplete transaction in the special mode negative remote crediting has occurred. The inconsistent data sets are corrected and the negative remote crediting is completed.

In a further embodiment of the invention an incremental counter is employed instead of a decremental counter. The comparison to the number that corresponds to the monitored time span must thus be implemented after each counting clock pulse.

A transgression of the time t1 is are liable indication for a failed transmission and effects the execution of a specific sub-program which prepares and automatically triggers a renewed implementation of the special mode for negative remote crediting. The first and second transactions are repeated automatically in this case with the cipher Kn+2.

After a successful interrogation or verification in the fifth step of the second transaction, the transmitted second cipher $Kn+2_{Cv+3}$ and the credited value are added to the descending register value R1 correspondingly in the postage meter machine FM. The resultant credit is stored, or given non-verification or a transgression of the time, a branch is made back to the first step of the first transaction.

The fifth step of the second transaction includes a sub-step 620 at the postage meter machine FM for resetting the aforementioned special flag N or for returning into the normal mode of the postage meter machine FM, as a result of which the aforementioned, automatic transaction requests are in turn canceled when the, implementation of the second transaction has been completed.

The on-site service technician secures the continued, malfunction-free execution up to the completion of the negative remote crediting.

If the completion thereof is not possible due to a longer or still-existing interruption of the connection between postage meter machine FM and data center DZ, the service technician must take the postage meter machine FM into the dealer's office and attempt to complete the transaction there. Otherwise, a credit would arise in the postage meter machine FM that, based on the information of the data center DZ, would be considered as having been validly returned The successful completion of the negative remote crediting, i.e. the return of the funds, can be checked by an interrogation of the register readings to make sure R1=0 or R2=R3 and R3=R2+R1.

The postage meter machine FM can communicate register values to the data center DZ, for example before a reloading with a NULL credit. These registers are R1 (descending register) remaining amount on hand in the postage meter machine FM R2 (ascending register) total amount used in the postage meter machine FM R3 (total resetting) the prior total credited amount of all remote crediting R4 (piece count Σ printing with value≠0) number of valid imprints, R8 (R4+piece count Σ printing with value=0) number of all imprints.

At least R1 can be interrogated and statistically interpreted at each remote crediting.

At the end of the day, the data center DZ evaluates the validity of the return of funds as a result of the special mode negative remote crediting. If a service technician has not reported any occurrence such as, for example, that the negative remote crediting could not be implemented, or if the same postage meter machine FM does not make a request for reloading a positive credit, validity is assumed.

The special flag N set upon entry into the special mode negative remote crediting is reset given a successful transaction. The postage meter machine FM prevents all frankings with values greater than zero because a credit is no longer loaded. The postage meter machine FM continues to be operational for frankings with values equal to zero and for other operating modes as long as these require no credit, as long as no postage is franked and the piece count limit has not been reached.

Either, as in the one embodiment, a triggering of the transactions in the special mode is effected by the predetermined lateral, special mode entry or, in another embodiment, at least a manual step 302 in the special mode negative remote crediting after an entry for input of an identification number (PIN) and for input of the predetermined crediting request is provided as in the positive remote crediting that is interrogated in step 303. As a result of an additional manual step for time-limited input that is interrogated in 603, a clear down of the second transaction and an exit occurs, or the repetition of the first transaction ensues in the communication mode, or in the special Anode if the input time is exceeded. The T-key must be actuated within thirty seconds or the input time will be considered to have been transgressed.

A number of versions having different security levels can also be realized. Thus, a check for communication of a predetermined crediting request can be implemented in the data center DZ. In the simplest case, the crediting request—analogous to the remaining amount R1 still on hand in the descending register that can be interrogated in the display mode 215—the crediting request must be entered and communicated to the data center DZ. Since the postal register contents (at least R1 ) are communicated automatically to the data center DZ in every transaction, a negative remote crediting for returning funds is achieved given coincidence of the crediting amount with the remaining amount.

In a second version, an arbitrary crediting request is agreed on in code with the data center DZ. A NULL crediting request is preferably agreed upon. When the special mode negative remote crediting is called within a predetermined time following the declaration and the NULL crediting request is entered, or confirmed as crediting request, the remaining amount R1 is automatically reset to NULL in the postage meter machine FM. A corresponding interrogation step 219 according to such a further, specific criterion for the postage meter machine FM is shown in broken lines in FIG. 2. From this, a branch is made to the step 220 for setting the special flag No. In a further embodiment, the operation can be simplified When a NULL remote crediting has already ensues as last transaction The only thing that must then be undertaken is the lateral entry in order to fully automatically implement the negative remote crediting, or in order to achieve a NULL remaining value R1=0.

A manipulation is time-limited by starting a time monitoring beginning with the sub-step 613 of sending the third crypto-message to the data center DZ up to the reception of the fourth crypto-message on the part of the postage meter machine FM. If the fourth crypto-message was not capable of being received within a predetermined time t1, a specific sub-program is called that prepares a renewed implementation of the special mode for negative remote crediting and automatically triggers it. As a result of further sub-steps 615, 616 and 301 for automatic reassumption of the communication after interruption of the communication connection between data center DZ and postage meter machine FM, or after the turn-off and subsequent turn-on of the postage meter machine FM, the communication continues to be implemented as long as the aforementioned special flag, N is set. The special flag N, interpreted as transaction request, is stored non-volatility and MAC-protected against manipulation. Only after the completion of the return of the credit is the special flag N reset in step 620.

In a third modification, the security is enhanced by a combination of various measures. Independently of the postage meter machine FM, a first communication connection is set up between an authorized user and the data center DZ for storing a code for a log-on of an authorized action at the postage meter machine FM with a crediting request communicated later. An activation of the postage meter machine FM can now ensue for undertaking the authorized, predetermined operating execution in order to enter into the special mode for negative remote crediting via a lateral entry. Following this, a second communication connection is set up between the postage meter machine FM and the data center DZ as well as an entry of a crediting request. In a first transaction, a distinguishable log-on ensues at the data center DZ when the communicated crediting request agrees with a corresponding code. In the first transaction, for example a new code word or security flag and/or operating sequence is communicated to the postage meter machine FM. By implementing at least one further transaction and due to the automatic implementation of the aforementioned communication, the security-associated data are transmitted and their storage in the postage meter machine FM is completed. Corresponding to the crediting request, the crediting value is added to the remaining credit in the corresponding memory of the postage meter machine FM and is also added in a corresponding memory of the data center DZ for checking the transaction.

Otherwise, a step 209 for erasing a security flag X stored manipulation-proof occurs as the result of at least one unallowed departure from the predetermined operating execution, or because operations were performed on the postage meter machine FM. The postage meter machine FM is thus switched (step 409) into a first mode in order to effectively shut it down for franking (franking mode 400) by comparison to the authorized action or intervention.

A transmission of a valid operating sequence from the data center DZ to the postage meter machine FM becomes superfluous when the operating sequence is modified time-dependent. The same calculating algorithm is employed in the data center DZ and in the postage meter, machine FM in order to identify a current operating sequence. Another embodiment proceeds on the basis of storing the current operating sequence in the postage meter machine FM with a specific reset $E^2$PROM by the service technician.

In a further embodiment, the security is enhanced by an authorized person on the basis of an additional input protection means that is brought into the contact with the postage meter machine FM in order to transmit a remaining credit back to the data center DZ. First, the current status is produced in the data center DZ by means of register readings being reported with a zero remote crediting. Subsequently, a reset read-only memory module (refund EPROM) is inserted into a predetermined socket of the at least partially open postage meter machine FM by the service technician as the aforementioned input protection means. After the activation, or after a lateral entry into the program of the postage meter machine FM, a check is made to determine whether a refund EPROM was inserted. This can advantageously ensue in step 219 shown in FIG. 2 for checking a further criterion. A proper lateral entry given a non-extent refund EPROM leads to point e or, in an embodiment that is not shown, leads to a step for aborting of the routine. For example, a branch can be made to a step 209 for erasing a flag X, this having been noted in step 409 of the franking mode (FIG. 4) and leading to statistics and error evaluation, or registration, in step 213. Otherwise, given a correct lateral entry and with the refund EPROM plugged in, a special flag N is set, this automatically triggering the refund of the remaining credits of the data center DZ in the communication mode.

In a further version of this embodiment, the steps 218 and 219 according to FIG. 2 can sequence interchanged in sequence, so that an interrogation is first made in view of the plugged-in refund EPROM and is made only thereafter in view of the correct lateral entry. Such aversion has the advantage that the information about the proper lateral entry can be likewise stored in the refund EPROM instead of in the postage meter machine FM. The security against manipulation with fraudulent intent is thus further enhanced.

The status of the postage meter machine FM (out of service) is stored in the data center DZ. The authorized person removes the input protection means from the socket and closes the housing of the postage meter machine FM. In the data center DZ, as well as in the postage meter machine FM, the postal registers that register the credit for available remaining credit R1, total used amount R2 and total amount R3 are set to zero (R1=0; R2=0; R3=F1+R2=0). The remaining credit of the customer has therby been returned to the corresponding account of the customer.

Given a chip card write/red unit present in the postage meter machine FM, the input protection means can also be realized as a chip card.

Although modifications and changes may be suggested by those skilled in the art, it is the intention of the inventors to embody within the patent warranted hereon all changes and modifications as reasoably and properly come within the scope of their contribution to the art.

We claim:

1. A method for improving the security against manipulation of a postage meter machine in credit transfers, said postage meter machine comprising a microprocessor which interfaces with an input unit of the postage meter machine for implementing, upon an input being entered via said input unit, a start and initialization routine in said microprocessor followed by a system routine with entry, if necessary into a communication mode with a remote data center for loading a credit value or for returning funds in a refund to the data center, and said microprocessor subsequently entering into a franking mode from which a branch is made back into the system routine after conducting an accounting and printing routine, said method comprising the steps of:

making an entry into said start and initialization routine in said microprocessor while undertaking an operator sequence in said input unit during turn-on of the postage meter machine;

said microprocessor intervening currently valid data identifying an authorized action;

monitoring said postage meter machine with the microprocessor, using said currently valid data, for distinguishing between authorized and unauthorized action;

said microprocessor switching the postage meter machine into a special mode for negative remote crediting with a step, interpreted in an interrogation step of the communication mode as a transaction request for a first transaction, if a plurality of predetermined criteria have been satisfied;

said microprocessor switching into a first mode in which said postage meter machine is prevented from franking if said operating sequence made in said input unit does not correspond to an allowed, predetermined operating sequence;

said microprocessor producing a communication connection and conducting an encrypted communication between said postage meter machine and said data center in said special mode; and monitoring with said microprocessor for completed implementation of said special mode.

2. A method as claimed in claim 1 wherein the step of monitoring for completed implementation of said special mode comprises interrogating whether said entry into said start and initialization is correct and distinguishing between completed and incomplete implementation of the special mode and, given incomplete implementation of said special mode, automatically continuing the communication with the data center with further transactions, including a second transacting, for completing a refund if at least one of interruption of implementation of the special mode or communication of incorrectly encrypted data to the postage meter machine occurs.

3. A method as claimed in claim 2 wherein said input unit comprises a keyboard having a plurality of keys and wherein said method comprises the further steps of:

storing a respective predetermined key combination at the data center for each postage meter machine as said allowed, predetermined operating sequence and informing only authorized personnel thereof; and employing said predetermined key combination as said specific criteria for switching into said special mode during turn-on of said postage meter machine in said entry into said start and initialization.

4. A method as claimed in claim 2 wherein the step of interrogating for the correct lateral entry comprises:

storing information identifying a correct entry into said start and initialization in an input security unit insertable into said postage meter machine;

checking to determine if said input security unit is inserted into said postage meter machine; and if said input security unit is inserted into said postage meter machine, reading said information therefrom with said microprocessor and using said information as criteria for a correct entry into said start and initialization.

5. A method as claimed in claim 4 wherein the step of storing information identifying a correct entry into said start and initialization in an input security unit comprises storing said information identifying a correct lateral entry in are fund EPROM pluggable into a receptacle in said postage meter machine, and wherein the step of checking to determine if said input security unit is inserted into said postage meter machine comprises checking to determine if said refund EPROM is plugged into said receptacle.

6. A method as claimed in claim 4 wherein said postage meter machine includes a chip card read/write unit communicating with said microprocessor, wherein the step of storing information identifying a correct lateral entry in an input security unit comprises storing said information identifying a correct lateral entry on a chip card, and wherein the step of checking to determine if said input security unit is inserted into said postage meter machine comprises checking to determine whether said chip card has been passed through said read/write unit.

7. A method as claimed in claim 2 comprising at least one manual step in said special mode after said entry into said start and initialization for entering an identification number and for entering a predetermined credit request and a manual step for entering a time limit via said input unit and automatically triggering said second transaction upon expiration of said time limit.

8. A method as claimed in claim 2 comprising at least one manual step in said special mode after said into said start and initialization entry for entering an identification number and for entering a predetermined credit request and a manual step for entering a time limit via said input unit and automatically repeating the first transaction upon expiration of said time limit.

9. A method as claimed in claim 2 comprising the additional steps of:

identifying the presence of a criterion for switching said postage meter machine into a second mode; and setting a sleeping flag in said franking mode during said second mode.

10. A method as claimed in claim 2 wherein said input unit comprises a keyboard having a plurality of keys, wherein the step of switching the postage meter machine into said special mode comprises switching said postage meter machine into said special mode upon entry of a predetermined combination of keys of said keyboard for entry into said special mode during turn-on of said postage meter machine, and setting a special flag protected against manipulation in said system routine when said postage meter machine is switched into said special mode.

11. A method as claimed in claim 9 comprising the additional steps of:

establishing communication with the data center by conducting at least said first transaction and said second transaction for making an automatic transaction request to complete a refund of credit;

a first step of said first transaction comprising sub-steps at the postage meter machine of setting up a first transaction connection to the data center, transmitting first transaction data including an identification associated with the postage meter machine and an identification of transaction type from the postage meter machine to the data center in unencrypted form;

a second step of the first transaction comprising sub-steps at the data center of receiving said first transaction data, checking the identification associated with the postage meter machine, and communicating an On encrypted "ok" message to the postage meter machine upon said identification associated with the postage meter machine being accepted at the data center;

a third step of the first transaction comprising sub-steps at the postage meter machine of forming a first encrypted crypto-message with a first cipher stored in the postage meter machine, said first crypto-message comprising at least a crediting request, said identification associated with the postage meter machine, and postal register data from registers contained in said postage meter machine, and transmitting said first crypto-message to the data center;

a fourth step of the first transaction comprising sub-steps at the data center of receiving and decrypting said first crypto-message, forming a second cipher using the first cipher used by the postage meter machine, forming a second encrypted crypto-message containing at least said second cipher, identification data and transaction data, and transmitting said second crypto-message to the postage meter machine;

a fifth step of the first transaction comprising sub-steps at the postage meter machine of receiving and decrypting said second crypto-message, extracting at least said identification data and said second cipher from the decrypted second crypto-message, verifying the received, second crypto-message on the basis of the extracted identification data, and given verification, storing the second cipher and the crediting request in said postage meter machine and given non-verification, branching back to said first step of said first transaction;

a first step of the second transaction comprising sub-step at the postage meter machine of setting up a second transaction connection, transmitting second transaction data including said identification associated with the postage meter machine and said transaction type from the postage meter machine to the data center in unencrypted form;

a second step of the second transaction comprising sub-steps at the data center of receiving said second transaction data, checking the identification associated with the postage meter machine, and communicating an encrypted "ok" message to the postage meter machine if said identification associated with the postage meter machine is acceptable;

a third step of the second transaction comprising sub-steps at the postage meter machine of forming a third encrypted crypto-message using the second cipher stored in the postage meter machine and comprising identification data and postal register data without a credit value, and transmitting said third crypto-message to the data center;

a fourth step of the second transaction comprising sub-steps at the data center of receiving and decrypting said third crypto-message, forming a third cipher using the second cipher transmitted by the postage meter machine, forming a fourth encrypted crypto-message containing said third cipher and said identification data and transaction data, and transmitting said fourth crypto-message to said postage meter machine; and a fifth step of the second transaction comprising sub-steps at the postage meter machine of receiving and decrypting said fourth crypto-message, extracting said identification data and said third cipher and said second transaction data from the decrypted fourth crypto-message, verifying the received fourth crypto-message on the basis of the extracted identification data, and given verification, storing said second cipher at the postage meter machine and adding the credit value to a descending register value in the postage meter machine to obtain a resultant credit and storing the resultant credit at said postage meter machine, and given non-verification, branching back to the first step of the first transaction.

12. A method as claimed in claim 11 wherein the step of establishing communication with the data center further comprises automatically re-assuming communication between said postage meter machine and the data center upon interruption of said communication.

13. A method as claimed in claim 11 wherein the step of establishing communication with the data center comprises maintaining said communication with the data center as long as said special flag for said special mode is set.

14. A method as claimed in claim 11 wherein said fourth step of said first transaction comprises a further sub-step of c7hecking said first crypto-message for decryptability with a cipher stored in said data center before attempting decrypting of said first crypto-message.

15. A method as claimed in claim 11 wherein the fourth step of the second transaction comprises a further sub-step of checking said third crypto-message for decryptability with a cipher stored in said data center before attempting decrypting of said third crypto-message.

16. A method as claimed in claim 11 wherein the fourth step of the first transaction at the data center includes further sub-steps at the data center of branching to said second step of said second transaction and storing said first cipher as a predecessor cipher and storing said second cipher as a successor cipher.

17. A method as claimed in claim 11 wherein the second step of the first transaction and the second step of the second transaction respectively include further sub-steps of, if a faulty unencrypted first or second transaction message, which cannot be corrected, is identified in the respective checking made at the data center in the respective second steps of the first and second transactions, branching at said data center to an error reporting routine and maintaining said data center in a quiescent condition until communication is re-assumed by said postage meter machine.

18. A method as claimed in claim 11 wherein the fourth step of the first transaction includes further sub-steps of, given a faulty first crypto message that cannot be corrected, branching to a routine for error reporting and placing said data center in a quiescent condition until communication is re-assumed by the postage meter machine, and given a faulty first crypto-message which can be corrected, branching to a sub-step for cancelling a previous transaction and branching to a sub-step in the data center for forming said second cipher, wherein the fourth step of the second transaction comprises further sub-steps of, given a faulty third crypto-message that cannot be corrected, branching to a step in said data center for error reporting and placing said data center in a quiescent condition until communication with said postage meter machine is re-assumed, and given a faulty third crypto-message having errors that can be corrected, branching to a step at said data center for cancelling said previous transaction and subsequently branching to a sub-step in said data center for forming said third cipher.

19. A method as claimed in claim 11 wherein the fourth step of the second transaction comprises a further sub-step for storing said credited value at said data center of branching to said second step of said first transaction for storing said second cipher as a predecessor cipher and said third cipher as a successor cipher for further first and second transactions.

20. A method as claimed in claim 11 wherein the fifth step of the second transaction comprises a further sub-step at said postage meter machine of resetting said special flag.

21. A method as claimed in claim 11 wherein the fifth step of the second transaction comprises a further sub-step of returning to a normal mode of operation of said postage meter machine and cancelling said automatic transaction request.

22. A method as claimed in claim 11 comprising the additional steps of:

starting a time monitor beginning with the transmitting, in the third step of the second transaction, of the third crypto-message to the data center and ending with the receiving, in the fifth step of the second transaction of the fourth crypto-message by the postage meter machine;

determining if the fourth crypto-message was received within a predetermined time;

if said fourth crypto-message was not received within said predetermined time, calling a sub-program for preparing at renewed implementation of said special mode and automatically triggering said renewed implementation;

automatically re-assuming communication between said postage meter machine and said data center after a break of said connection between said data center and said postage meter machine;

evaluating said special flag as a transaction request and non-volatilely storing said special flag MAC-protected against manipulation;

continuing the communication as long as the special flag is set; and resetting said special flag only after completion of said refund of credit.

23. A method for improving the security against manipulation of a postage meter machine in credit transfers, said postage meter machine comprising a microprocessor which interfaces with an input unit of the postage meter machine for implementing, upon an input being entered via said input unit, a start and initialization routine in said microprocessor followed by a system routine with entry, if necessary into a communication mode with a remote data center for loading a credit value or for returning funds in a refund to the data center, and said microprocessor subsequently entering into a franking mode from which a branch is made back into the system routine after conducting an accounting and printing routine, said method comprising the steps of:

setting up a first communication connection between an authorized user and the data center independently of said postage meter machine and storing a code for a predetermined credit value for use in a log-on of an authorized action at the postage meter machine by a credit request to be subsequently communicated to the data center;

activating the postage meter machine by an authorized, predetermined operating sequence via said input unit for causing said microprocessor to enter into a special mode for negative remote crediting;

setting up a second communication connection between the postage meter machine and the data center and entering a data request via said input unit, implementing a first transaction after entry of the postage meter machine into the communication mode and after setting up said connection to the data center; setting a credit request at said postage meter machine corresponding to a remaining, refunded credit value in said postage meter machine only if said operating sequence entered via said input unit corresponds to an allowed, predetermined operating sequence and only if the credit value communicated to the data center corresponds with the code stored therein for the predetermined credit value; and conducting a further transaction for automatically transmitting security-associated data to the postage meter machine and for completing the storage of said security-associated data in said postage meter machine.

24. A method as claimed in claim 23 comprising the additional steps of:

no later than after said into said special mode entry, running said start and initialization routine and thereby reaching a start of said system routine and conducting an interrogation of criteria for determining entry into one of said modes;

entering into said communication mode or branching to said franking mode dependent on said criteria; and conducting transactions with encrypted messages during communication between said postage meter machine and said data center for loading at least one credit request into the postage meter machine.

25. A method as claimed in claim 23 wherein said input unit comprises a keyboard having a plurality of keys, and said method comprising the additional steps of:

before log-on of said authorized action at said postage meter machine, storing a predetermined key combination in said data center, required in order to achieve said predetermined operating sequence;

upon actuation of said predetermined key combination, activating the postage meter machine for implementing said special mode for negative recrediting; and automatically implementing a communication between said postage meter machine and said data center to complete a refund of the credit.

26. A method as claimed in claim 23 comprising the additional step of:

upon recognition of said code from said credit request in the data center, communicating a new predetermined operating sequence from the data center to the postage meter machine during the second communication with encrypted messages, said new predetermined operating sequence being based on the code of the credit request.

27. A method as claimed in claim 23 comprising the additional steps for, when a specific criterion is met, switching the postage meter machine into said special mode for negative remote crediting after a start of the system routine for retrieving current data, of:

storing said authorized predetermined execution at said postage meter machine;

identifying if a prohibited entry into said special mode has occurred by comparing an attempted operating execution for entry into said special mode to said authorized, predetermined operating execution;

storing a security flag at said postage meter machine which must be present in said postage meter machine in order to permit franking by said postage meter machine;

given a prohibited entry into said special mode, erasing the security flag to prevent franking by the postage meter machine;

checking for a correct entry into said special mode by comparison of said attempted into said special mode entry to first criteria communicated during a transaction with said data center;

checking for a correct entry into said special mode by comparison of said attempted into said special mode entry with a second criteria;

given satisfaction of both said first and second criteria, setting a special flag for automatically entering into a communication mode for communication with the data center; and given non-satisfaction of either said first or second criteria, branching to a different mode if no communication request is present.

28. A method as claimed in claim 23 comprising switching the postage meter machine into a second mode by conducting the steps of:

checking an attempted en try into said special mode against predetermined criteria and entering, given satisfaction of the criteria, into the second mode and emitting a warning and a request for a second mode communication with the data center; and conducting said second mode communication with encrypted messages for implementing a transaction with a specific piece count communicated from the data center to the postage meter machine.

29. A method as claimed in claim 28 comprising the additional step of:

if the piece count has been consumed in the postage meter machine, setting a flag in the postage meter machine for automatically entering into the communication mode for conducting a transaction of the specific piece count communicated from the data center to the postage meter machine.

30. A method as claimed in claim 29 comprising the additional step of conducting an error statistics and evaluation and resetting said flag.

31. A method for improving the security against manipulation of a postage meter machine in credit transfers, said postage meter machine comprising a microprocessor which interfaces with an input unit of the postage meter machine for implementing, upon an input being entered via said input unit, a start and initialization routine in said microprocessor followed by a system routine with entry, if necessary into a communication mode with a remote data center for loading a credit value or for returning funds in a refund to the data center, and said microprocessor subsequently entering into a franking mode from which a branch is made back into the system routine after conducting an accounting and printing routine, said method comprising the steps of:

establishing a first communication connection between said postage meter machine and the data center and storing a code for a predetermined credit value for use in a log-on of an authorized action at the postage meter machine by a credit request to be subsequently communicated to the data center;

activating the postage meter machine by an authorized, predetermined operating sequence via said input unit for entering into a special mode for negative remote crediting;

establishing a second communication connection between the postage meter machine and the data center and entering a data request via said input unit, implementing a first transaction after entry of the postage meter machine into the communication mode and after setting up said connection to the data center, setting a credit request at said postage meter machine corresponding to a remaining, refunded credit value in said postage meter machine only if said operating sequence entered via said input unit corresponds to an allowed, predetermined operating sequence and only if the credit value communicated to the data center corresponds with the code stored therein for the predetermined credit value;

storing a security flag in said postage meter machine which must be present in said postage meter machine in order to permit franking by said postage meter machine;

said microprocessor automatically erasing said security flag upon an occurrence at least one event selected from the group of events consisting of an unallowed departure from said predetermined operating sequence and an intervention into the postage meter machine; and said microprocessor switching the postage meter machine into a first mode in which postage meter machine is prevented from franking.

32. A method as claimed in claim 31 comprising the additional steps of:

no later than after said entry into said special mode, running said start and initialization routine and thereby reaching a start of said system routine and conducting an interrogation of criteria for determining entry into one of said modes;

entering into said communication mode or branching to said franking mode dependent on said criteria; and conducting transactions with encrypted messages during communication between said postage meter machine and said data center for loading at least one credit request into the postage meter machine.

33. A method as claimed in claim 31 wherein said input unit comprises a keyboard having a plurality of keys, and said method comprising the additional steps of:

before log-on of said authorized action at said postage meter machine, storing a predetermined key combination in said data center, required in order to achieve said predetermined operating sequence;

upon actuation of said predetermined key combination, activating the postage meter machine for implementing said special mode for negative recrediting; and automatically implementing a communication between said postage meter machine and said data center to complete a refund of the credit.

34. A method as claimed in claim 31 wherein the step of switching the postage meter machine into the first mode for preventing franking comprises:

transmitting a new security flag from the data center to the postage meter machine;

erasing the security flag in the postage meter machine and replacing it with said new security flag;

using said new security flag as a valid security flag after running said start and initialization routine;

repeatedly interrogating for the presence of said valid security flag during the operation of said postage meter machine before an accounting and printing routine within said franking mode; and conducting the accounting and printing routine, given the presence of a valid security flag, and if a valid security flag is hot present, branching to a statistics and error evaluation mode and thereafter to a display mode and subsequently branching back to a start of said system routine.

35. A method for improving the security against manipulation of a postage meter machine in credit transfers, said postage meter machine comprising a microprocessor which interfaces with an input unit of the postage meter machine for implementing, upon an input being entered via said input unit, a start and initialization routine in said microprocessor followed by a system routine with entry, if necessary into a communication mode with a remote data center for loading a credit value or for returning funds in a refund to the data center, and said microprocessor subsequently entering into a franking mode from which a branch is made back into the system routine after conducting an accounting and printing routine, said method comprising the steps of:

conducting a communication between said postage meter machine and said data center including transmission of encrypted messages between said postage meter machine and said data center;

distinguishing between authorized action and unauthorized action at said postage meter machine with said microprocessor of said postage meter machine in combination with implementing a remote crediting for transmitting a credit value to said data center by communicating a credit request from the postage meter machine to the data center during a first transaction, and conducting a responsive, second transaction from the data center to the postage meter machine, and after completing said second transaction, adding a credit value corresponding to said credit request to a value of a descending register in the postage meter machine and storing said credit value;

upon deactivation and subsequent reactivation of said postage meter machine, said microprocessor requiring a defined execution of said input unit with a predetermined actuation sequence in order to permit further first and second transactions;

before implementing said further first and second transactions, conducting a check with said microprocessor to determine whether a positive credit request or a negative credit request corresponding to an amount of remaining credit stored in said descending register has been requested and checking in said microprocessor whether a predetermined time limit was exceeded;

during said further second transaction, checking whether a predetermined time limit is exceeded during execution of said further second transaction; and if necessary, automatically continuing the communication to complete a transaction either of interruption of a negative remote crediting or communication of faulty encrypted data to the postage meter machine occurs.

36. A method as claimed in claim 35 wherein the step of conducting a communication between said postage meter machine and said data center comprises employing said encrypted messages at least for loading a recrediting amount into said postage meter machine.

37. A method as claimed in claim 35 wherein the step of conducting a communication between said postage meter machine and said data center comprises employing said encrypted messages at least for loading a current data into said postage meter machine.

38. A method as claimed in claim 35 wherein conducting said first transaction and said second transaction are further defined by the steps of:

conducting said first transaction with encrypted messages generated using a cipher in said postage meter machine; and conducting said second transaction with encrypted messages generated using a further cipher generated at said data center from said first cipher, and wherein said second transaction includes transmitting said further cipher to said postage meter machine for use in conducting said further first transaction.

39. A method for improving the security against manipulation of a postage meter machine in credit transfers, said postage meter machine comprising a microprocessor which interfaces with an input unit of the postage meter machine for implementing, upon an input being entered via said input unit, a start and initialization routine in said microprocessor followed by a system routine with entry, if necessary into a communication mode with a remote data center for loading a credit value or for returning funds in a refund to the data center, and said microprocessor subsequently entering into a franking mode from which a branch is made back into the system routine after conducting an accounting and printing routine, said method comprising the steps of:

setting up a communication connection between an authorized person and said data center independently of said postage meter machine for obtaining a credit value and subsequently storing said credit value in said postage meter machine;

entering a credit request into said postage meter machine via said input unit and logging-on said credit request as an authorized action if said credit request corresponds to said credit value obtained from the data center;

conducting a first transaction between the postage meter machine and said data center including storing a predetermined key combination in said postage meter machine;

logging-on said credit request at said data center if said credit value corresponds to the credit value obtained from the data center;

requiring the presence of a security flag in said postage meter machine in order to conduct franking;

said microprocessor automatically storing a new security flag in said postage meter machine during said first transaction; and conducting a second transaction for modifying a remaining credit of said postage meter machine.

40. A method for improving the security against manipulation of a postage meter machine in credit transfers, said postage meter machine comprising a microprocessor which interfaces with an input unit of the postage meter machine for implementing, upon an input being entered via said input unit, a start and initialization routine in said microprocessor followed by a system routine with entry, if necessary into a communication mode with a remote data center for loading a credit value or for returning funds in a refund to the data center, and said microprocessor subsequently entering into a franking mode from which a branch is made back into the system routine after conducting an accounting and printing routine, said method comprising the steps of:

undertaking an authorized manual action in conjunction with an entry in said input unit;

said microprocessor retrieving currently valid data identifying said authorized action;

monitoring said postage meter machine with the microprocessor, using said currently valid data, for distinguishing between authorized and unauthorized action;

said microprocessor switching the postage meter machine into a special mode for negative remote crediting with a step, interpreted in an interrogation step of the communication mode as a transaction request for a first transaction, if a plurality of predetermined criteria have been satisfied;

said microprocessor switching into a first mode in which said postage meter machine is prevented from franking if said manual action made in conjunction with an entry in said postage meter machine is unauthorized;

said microprocessor producing a communication connection and conducting an encrypted communication between said postage meter machine and said data center in said special mode; and monitoring with said microprocessor for completed implementation of said special mode.

* * * * *